US011611159B2

(12) United States Patent
Sato

(10) Patent No.: US 11,611,159 B2
(45) Date of Patent: Mar. 21, 2023

(54) METHOD OF MANUFACTURING TERMINAL-EQUIPPED ELECTRICAL WIRE AND TERMINAL-EQUIPPED ELECTRICAL WIRE

(71) Applicant: Yazaki Corporation, Tokyo (JP)

(72) Inventor: Kei Sato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/199,406

(22) Filed: Mar. 11, 2021

(65) Prior Publication Data

US 2021/0296792 A1 Sep. 23, 2021

(30) Foreign Application Priority Data

Mar. 18, 2020 (JP) ..... JP2020-047458
Jul. 22, 2020 (JP) ..... JP2020-124832

(51) Int. Cl.
*H01R 4/18* (2006.01)
*H01R 43/26* (2006.01)
*H01R 43/02* (2006.01)
*H01R 4/2404* (2018.01)

(52) U.S. Cl.
CPC ..... *H01R 4/183* (2013.01); *H01R 4/2404* (2013.01); *H01R 43/0221* (2013.01); *H01R 43/26* (2013.01)

(58) Field of Classification Search
CPC .... H01R 43/0221; H01R 43/26; H01R 4/183; H01R 4/2404
USPC ..... 439/874
See application file for complete search history.

(56) References Cited

U.S. PATENT DOCUMENTS 2,513,365 A * 7/1950 Rogoff ..... H01R 4/625 205/213
5,541,365 A 7/1996 Sugiura et al.
7,705,265 B2 * 4/2010 Asakura ..... H01R 43/0221 228/136
2015/0360319 A1 * 12/2015 Yagi ..... B23K 26/082 219/121.64
2016/0199932 A1 * 7/2016 Kern ..... H01R 4/187 439/874

FOREIGN PATENT DOCUMENTS

JP S62-55878 A 3/1987
JP H06-56969 U 8/1994
(Continued)

*Primary Examiner* — Gary F Paumen
(74) *Attorney, Agent, or Firm* — Kenealy Vaidya LLP

(57) ABSTRACT

A method of manufacturing a terminal-equipped electrical wire includes: inserting a core-wire exposed part of a core wire of an electrical wire at a terminal between inner wall surfaces of a pair of piece parts of a terminal fitting including a core-wire connection body formed of a bottom part and the piece parts protruding from both ends of the bottom part, and placing the core-wire exposed part on an inner wall surface of the bottom part; melting the core-wire exposed part and the core-wire connection body by emitting a laser beam to the core-wire exposed part and the core-wire connection body from a free end side of each piece part; and fixing the core-wire exposed part and the core-wire connection body melted by the laser beam, with the emission of the laser beam stopped.

18 Claims, 16 Drawing Sheets

(56) References Cited

FOREIGN PATENT DOCUMENTS

| | | | |
|---|---|---|---|
| JP | H06-325803 | A | 11/1994 |
| JP | 2013-186949 | A | 9/2013 |
| JP | 2017-174689 | A | 9/2017 |

* cited by examiner

METHOD OF MANUFACTURING TERMINAL-EQUIPPED ELECTRICAL WIRE AND TERMINAL-EQUIPPED ELECTRICAL WIRE

CROSS-REFERENCE TO RELATED APPLICATION(S)

The present application claims priority to and incorporates by reference the entire contents of Japanese Patent Application No. 2020-047458 filed in Japan on Mar. 18, 2020 and Japanese Patent Application No. 2020-124832 filed in Japan on Jul. 22, 2020.

BACKGROUND OF THE INVENTION

1. Field of the Invention

The present invention relates to a method of manufacturing a terminal-equipped electrical wire and a terminal-equipped electrical wire.

2. Description of the Related Art

In a conventionally known terminal-equipped electrical wire, a terminal fitting is physically and electrically connected with a terminal of an electrical wire. Typically, in the terminal-equipped electrical wire, the electrical wire connection body and the core wire of the electrical wire at the terminal are physically and electrically connected through swage press bonding of an electrical wire connection body of the terminal fitting to the terminal of the electrical wire, laser welding of the electrical wire connection body to a core wire of the electrical wire at the terminal, or the like. For example, such terminal-equipped the electrical wires are disclosed in Japanese Utility Model Application Laid-open No. H6-56969, Japanese Patent Application Laid-open No. S62-55878, and Japanese Patent Application Laid-open No. 2013-186949. In the terminal-equipped electrical wire disclosed in Japanese Utility Model Application Laid-open No. H6-56969, the core wire of the terminal of an electrical wire squashed to a flat shape in advance is placed on a bottom part of the electrical wire connection body, temporarily fastened to the electrical wire connection body by a piece body of a bent terminal fitting, and then laser-welded with the electrical wire connection body. In the terminal-equipped electrical wire disclosed in Japanese Patent Application Laid-open No. S62-55878, the core wire of the terminal of an electrical wire is fitted and temporarily fastened to a housing unit of the electrical wire connection body smaller than the diameter of the core wire and then laser-welded with the electrical wire connection body. In the terminal-equipped electrical wire disclosed in Japanese Patent Application Laid-open No. 2013-186949, strands of an electrical wire at a terminal are welded to each other in advance, and the electrical wire connection body is swaged and bonded by pressing to this melted-fixed part.

In the terminal-equipped electrical wire disclosed in Japanese Utility Model Application Laid-open No. H6-56969, only a laser beam emission part side is welded in the core wire and the electrical wire connection body. In addition, in the terminal-equipped electrical wire disclosed in Japanese Utility Model Application Laid-open No. H6-56969, for example, strands of the core wire unravel through the core wire flat-shaping process and the temporarily fastening process by the piece body, and the strands potentially protrude from the electrical wire connection body. Thus, the terminal-equipped electrical wire disclosed in Japanese Utility Model Application Laid-open No. H6-56969 has room for improvement of the state of connection between the core wire and the electrical wire connection body, which can lead to improvement of the quality of conduction between the electrical wire and the terminal fitting. Furthermore, in the terminal-equipped electrical wire disclosed in Japanese Utility Model Application Laid-open No. H6-56969, the flat-shaping process and the temporarily fastening process need to be performed before a laser welding process, and thus there is also room for improvement of productivity. In the terminal-equipped electrical wire disclosed in Japanese Patent Application Laid-open No. S62-55878, the core wire of the electrical wire at the terminal is fitted to the U-shaped housing unit of the electrical wire connection body in a closely contact state. Thus, in the terminal-equipped electrical wire disclosed in Japanese Patent Application Laid-open No. S62-55878, only a laser beam emission part side is welded in the core wire and the electrical wire connection body, and thus the state of connection between the core wire and the electrical wire connection body has room for improvement, which can lead to improvement of the quality of conduction between the electrical wire and the terminal fitting. In the terminal-equipped electrical wire disclosed in Japanese Patent Application Laid-open No. 2013-186949, the strands of the electrical wire at the terminal are welded in advance to avoid unraveling and prevented from protruding from the electrical wire connection body, and thus the quality of conduction can be prevented from decreasing due to protrusion of the strands. However, in the terminal-equipped electrical wire disclosed in Japanese Patent Application Laid-open No. 2013-186949, the strands need to be welded before a press bonding process, and thus there is room for improvement of productivity. As described above, with the conventional terminal-equipped electrical wires, it is difficult to achieve both favorable conduction quality and favorable productivity.

SUMMARY OF THE INVENTION

The present invention is thus intended to provide a method of manufacturing a terminal-equipped electrical wire and a terminal-equipped electrical wire that are capable of improving conduction quality and productivity.

In order to achieve the above mentioned object, a method of manufacturing a terminal-equipped electrical wire according to one aspect of the present invention includes an electrical wire installation process of inserting a core-wire exposed part of a core wire of an electrical wire at a terminal between inner wall surfaces of a pair of piece parts of a terminal fitting including a core-wire connection body formed of a bottom part and the piece parts protruding from both ends of the bottom part, and of placing the core-wire exposed part on an inner wall surface of the bottom part, the electrical wire having a core-wire diameter smaller than a protrusion height of each piece part from a lowermost surface of the bottom part; a melting process of melting the core-wire exposed part and the core-wire connection body by emitting a laser beam to the core-wire exposed part and the core-wire connection body from a free end side of each piece part; and a fixation process of fixing the core-wire exposed part and the core-wire connection body melted by the laser beam, with the emission of the laser beam stopped.

According to another aspect of the present invention, in the method of manufacturing a terminal-equipped electrical wire, it is desirable that at the melting process, the emitted laser beam has a width larger than an interval between the inner wall surfaces of the piece parts at free ends and smaller than an interval between outer wall surfaces of the piece parts at the free ends.

According to still another aspect of the present invention, in the method of manufacturing a terminal-equipped electrical wire, it is desirable to further includes a terminal installation process of installing the core-wire connection body on a terminal holding jig including a placement part and a pair of side wall parts protruding from both ends of the placement part, before performing the electrical wire installation process, wherein at the terminal installation process, the bottom part is placed on an inner wall surface of the placement part, and the piece parts are sandwiched between the pair of side wall parts made of a laser-beam transmitting material having a melting point higher than melting points of the core-wire exposed part and the core-wire connection body.

According to still another aspect of the present invention, in the method of manufacturing a terminal-equipped electrical wire, it is desirable to further includes a terminal installation process of installing the core-wire connection body on a terminal holding jig including a placement part and a pair of side wall parts protruding from both ends of the placement part, before performing the electrical wire installation process, wherein at the terminal installation process, the bottom part is placed on an inner wall surface of the placement part, and the piece parts are sandwiched between the pair of side wall parts made of a laser-beam transmitting material having a melting point higher than melting points of the core-wire exposed part and the core-wire connection body, and at the melting process, the laser beam is emitted at a width larger than an interval between the inner wall surfaces of the piece parts at free ends and smaller than an interval between outer wall surfaces of the side walls part at free ends.

According to still another aspect of the present invention, in the method of manufacturing a terminal-equipped electrical wire, it is desirable that at the electrical wire installation process, the core-wire exposed part in which a section orthogonal to an axis line is an incircle of the arc-shaped inner wall surface of the bottom part is placed on the arc-shaped bottom part.

According to still another aspect of the present invention, in the method of manufacturing a terminal-equipped electrical wire, it is desirable that at the electrical wire installation process, the core-wire exposed part is inserted between inner wall surfaces of the inner wall layer of the piece parts of the core-wire connection body including an outer wall layer on an outer wall surface side and an inner wall layer on an inner wall surface side, which is made of a metallic material having a melting point lower than melting point of the outer wall layer, and the core-wire exposed part is placed on an inner wall surface of the inner wall layer of the bottom part.

According to still another aspect of the present invention, in the method of manufacturing a terminal-equipped electrical wire, it is desirable that at the electrical wire installation process, the core-wire exposed part of the core wire including a plurality of strands is inserted between the inner wall surfaces of the piece parts and placed on the inner wall surface of the bottom part.

In order to achieve the above mentioned object, a terminal-equipped electrical wire according to still another aspect of the present invention includes an electrical wire; and a terminal fitting that includes a core-wire connection body formed of a bottom part and a pair of piece parts protruding from both ends of the bottom part and in which a core-wire exposed part of a core wire of the electrical wire at a terminal is physically and electrically connected with the core-wire connection body on an inner wall surface side of the bottom part and an inner wall surface side of each piece part, wherein the core-wire exposed part and the core-wire connection body form a melted-fixed part that is melted and then fixed.

In order to achieve the above mentioned object, a terminal-equipped electrical wire according to still another aspect of the present invention includes an electrical wire; and a terminal fitting that includes a core-wire connection body formed of a bottom part and a pair of piece parts protruding from both ends of the bottom part and in which a core-wire exposed part of a core wire of the electrical wire at a terminal is physically and electrically connected with the core-wire connection body on an inner wall surface side of the bottom part and an inner wall surface side of each piece part, wherein the core-wire connection body includes an outer wall layer on an outer wall surface side and an inner wall layer on an inner wall surface side, which is made of a metallic material having a melting point lower than melting point of the outer wall layer, and a melted-fixed part in which the core-wire exposed part and the inner wall layer are melted and then fixed is provided between the core-wire exposed part and the core-wire connection body.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of a method of manufacturing a terminal-equipped electrical wire and a terminal-equipped electrical wire according to the present invention will be described below in detail with reference to the accompanying drawings. The present invention is not limited to the present embodiment.

Embodiment

One embodiment of a method of manufacturing a terminal-equipped electrical wire and a terminal-equipped electrical wire according to the present invention will be described below with reference to FIGS. 1 to 5.

Figure 1:
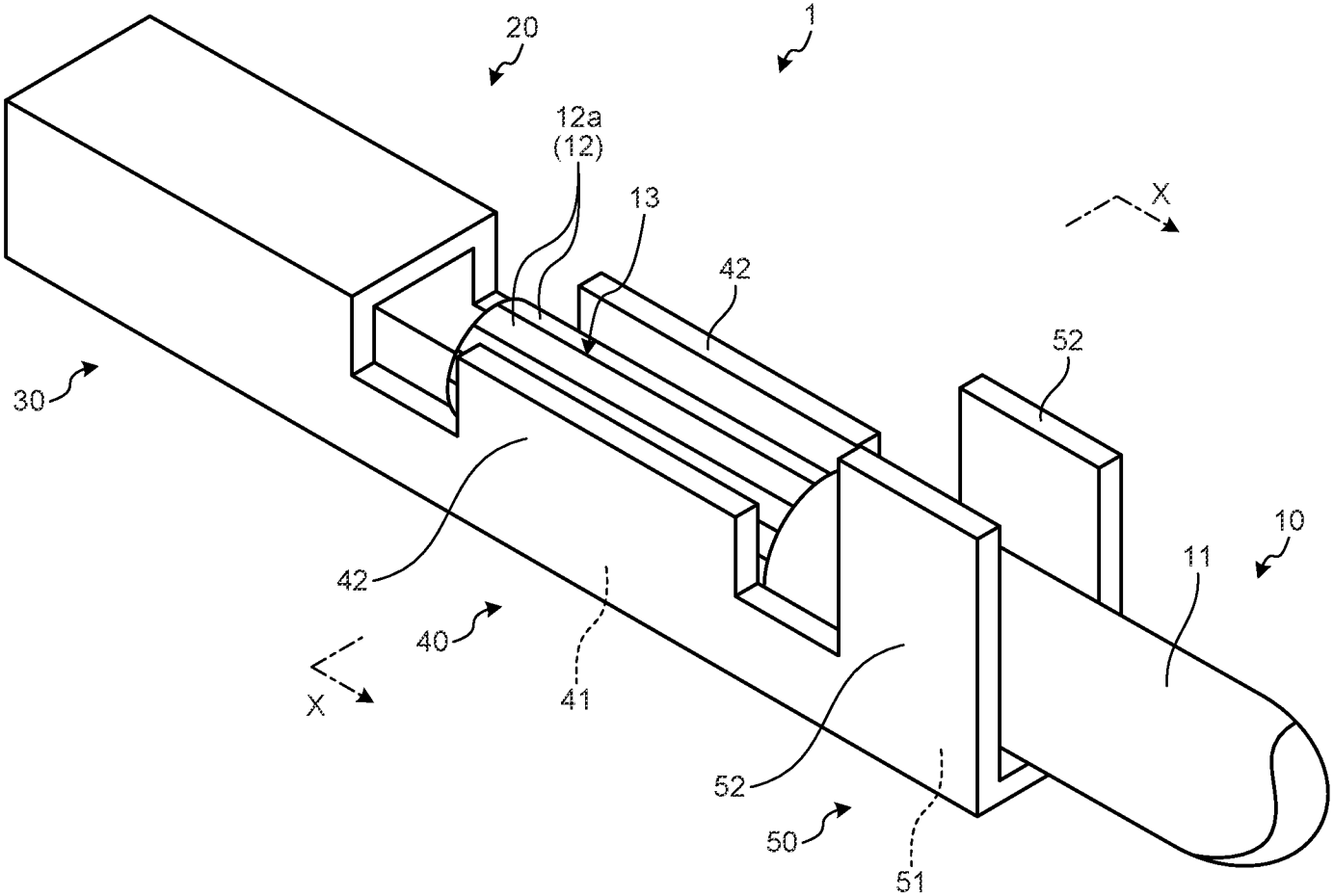
FIG. 1 is a perspective view illustrating a terminal-equipped electrical wire of an embodiment in a state before being subjected to a melting process, a fixation process, and a press bonding process.

Reference sign 1 in FIG. 1 denotes the terminal-equipped electrical wire of the present embodiment. This terminal-equipped electrical wire 1 is manufactured by a manufacturing method to be described later.

The terminal-equipped electrical wire 1 includes an electrical wire 10 and a terminal fitting 20 physically and electrically connected with each other (FIG. 1).

At a terminal of the electrical wire 10, a cover 11 is removed to expose a core wire 12 (FIG. 1). The core wire 12 may be a cylindrical bundle of a plurality of strands each made of a conductive metal wire rod or may be one cylindrically shaped bar conductor. The core wire 12 in this example is made of a plurality of strands 12*a*. In the electrical wire 10, a part of the core wire 12 at which the cover 11 is removed at the terminal is referred to as a "core-wire exposed part 13".

The terminal fitting 20 is formed of a metallic material such as a metal plate. The terminal fitting 20 includes a terminal connection body 30 physically and electrically connected with a terminal connection body of a counterpart terminal fitting (not illustrated), a core-wire connection body 40 physically and electrically connected with the core-wire exposed part 13 at the terminal of the electrical wire 10, and a cover connection body 50 physically connected with the cover 11 at the terminal of the electrical wire 10 (FIGS. 1 and 2).

For example, one of the terminal connection body 30 of the terminal fitting 20 and the terminal connection body of the counterpart terminal fitting is formed in a female terminal shape, and the other is formed in a male terminal shape so that the terminal connection bodies are engaged with each other by insertion. In this example, the terminal connection body 30 of the terminal fitting 20 is formed in a female terminal shape, and the terminal connection body of the counterpart terminal fitting is formed in a male terminal shape.

Figure 2:
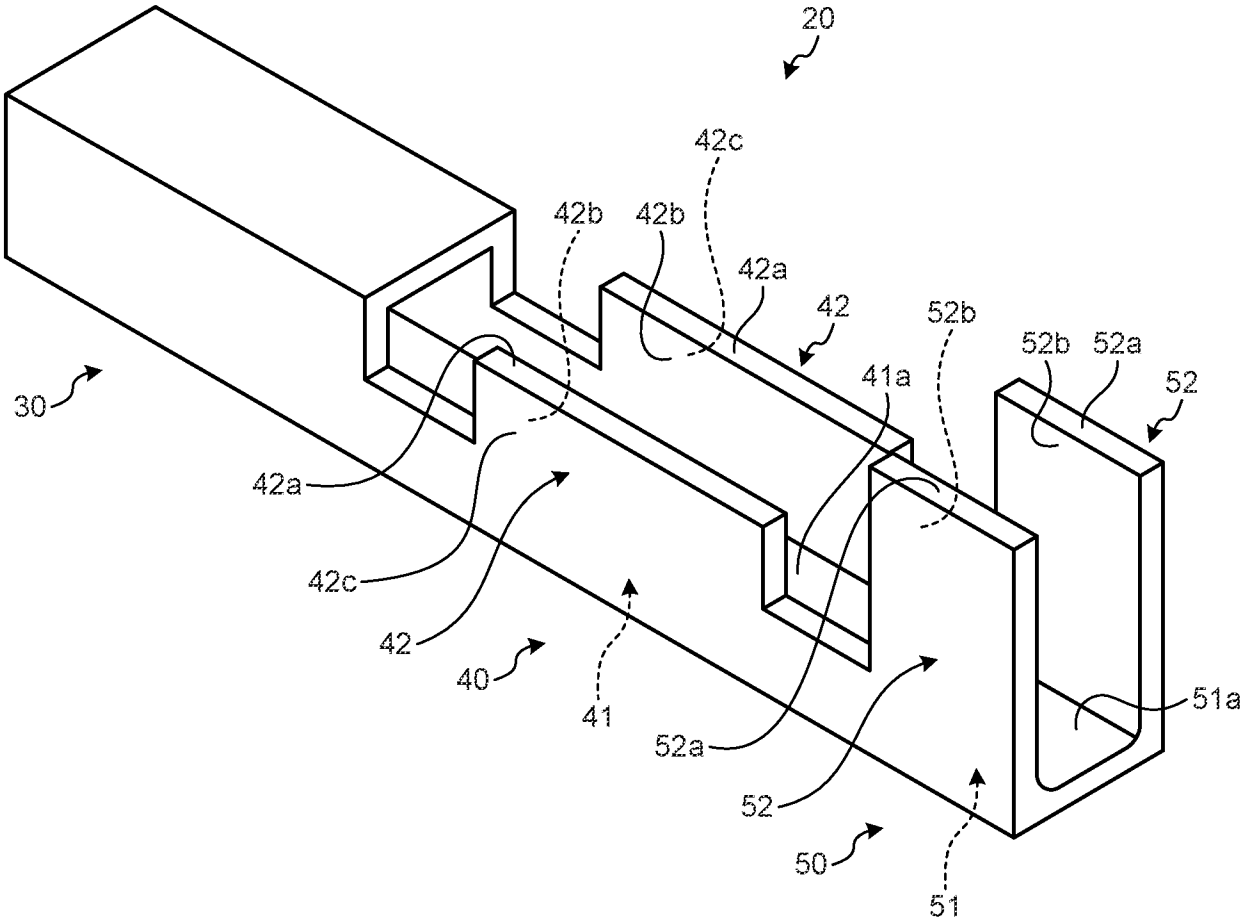
FIG. 2 is a perspective view illustrating a terminal fitting of the embodiment.

The core-wire connection body 40 includes a bottom part 41 and a pair of piece parts 42, 42 protruding from both ends of the bottom part 41 (FIGS. 1 and 2). The core-wire exposed part 13 is housed in a space surrounded by the bottom part 41 and the pair of piece parts 42, 42. The core-wire connection body 40 in this example before connection with the core-wire exposed part 13 (before physical and electrical connection with the core-wire exposed part 13) is formed in a plate shape of a U figure constituted by the bottom part 41 and the pair of piece parts 42, 42. Hereinafter, the shape of the core-wire connection body 40 means its shape before connection with the core-wire exposed part 13 unless otherwise stated.

Figure 3:
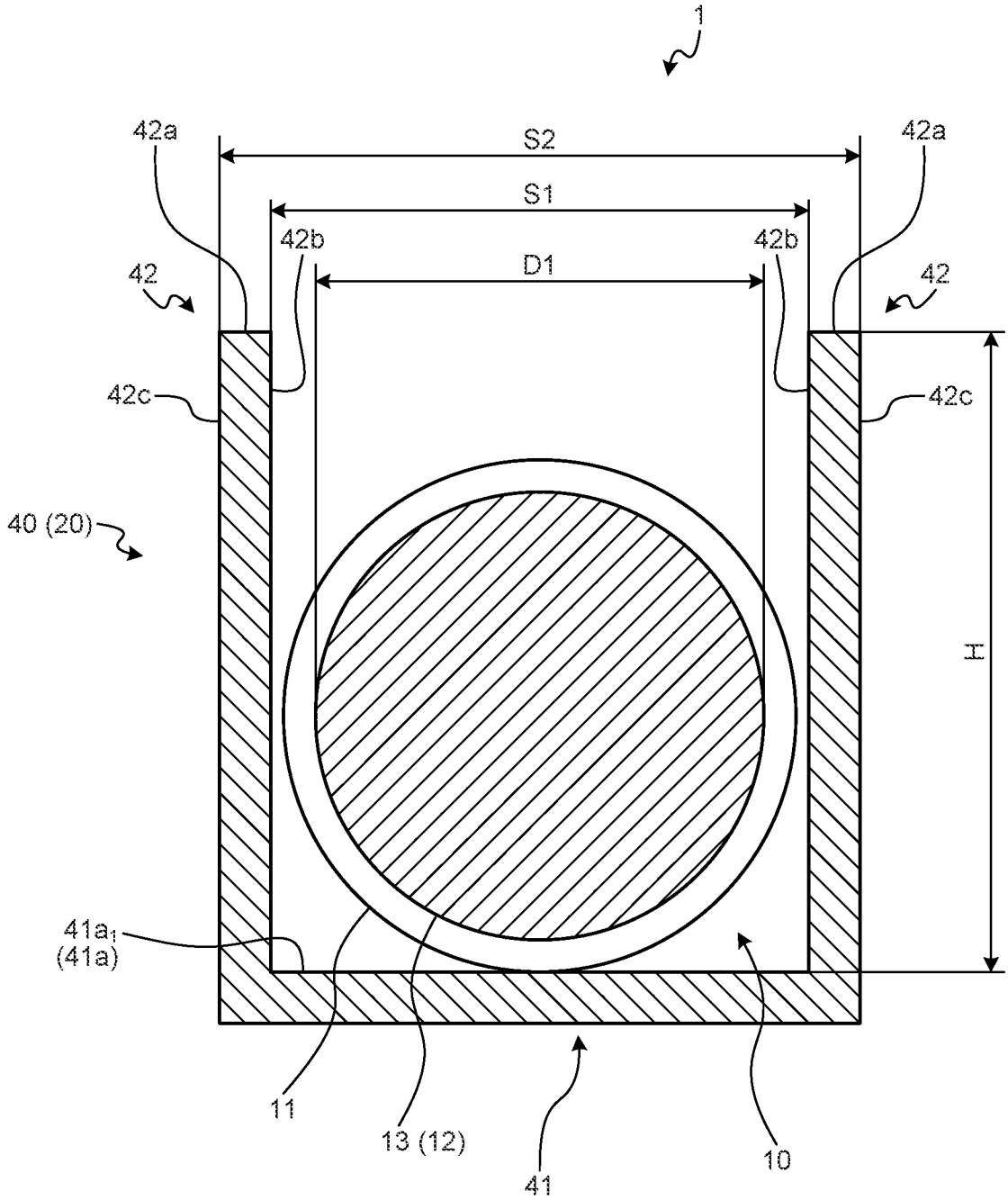
FIG. 3 is a cross-sectional view taken along line X-X in FIG. 1, illustrating a core-wire exposed part and a core-wire connection body of the embodiment before being subjected to the melting process and the fixation process.
Figure 4:
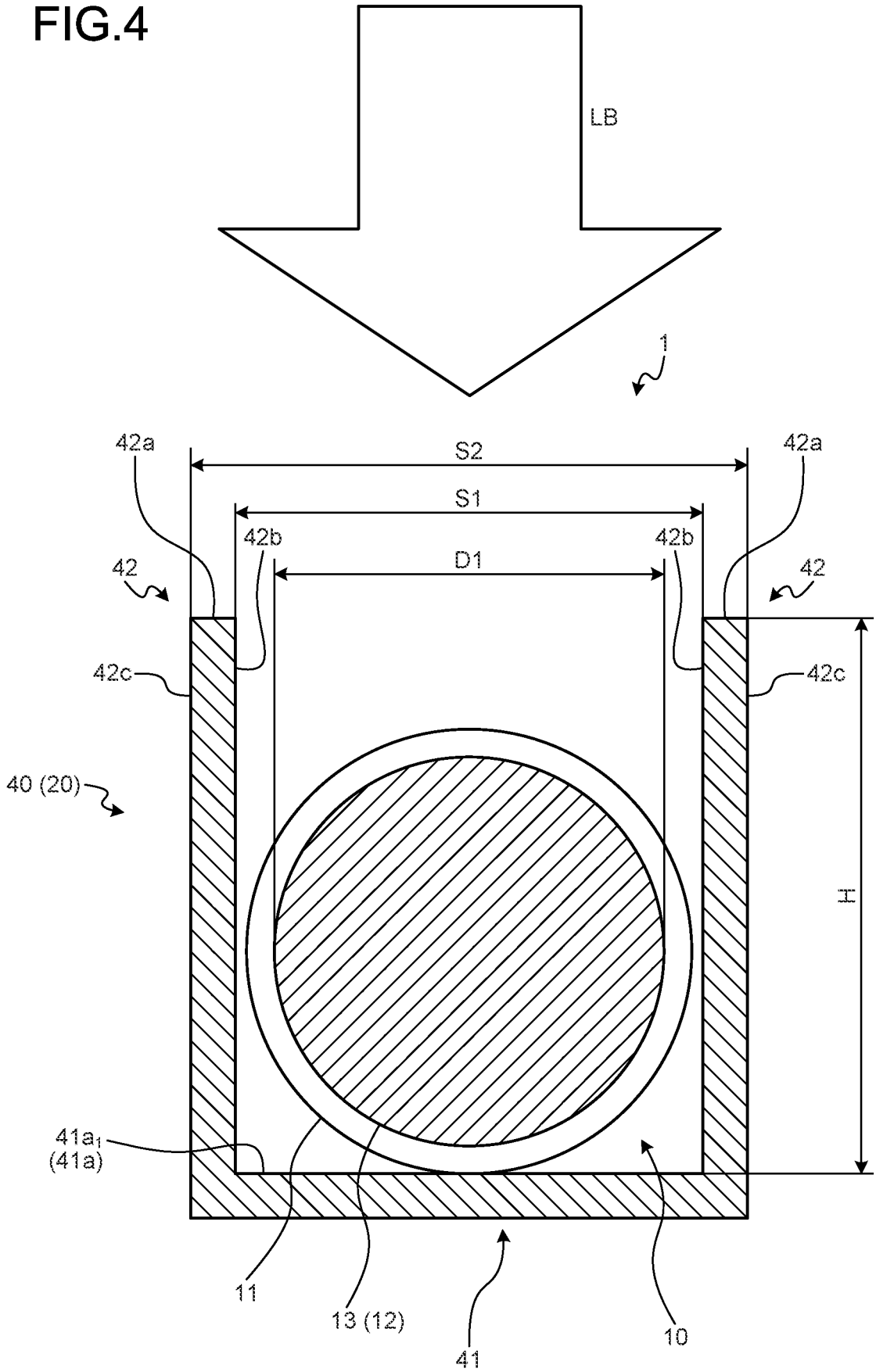
FIG. 4 is a cross-sectional view illustrating the core-wire exposed part and the core-wire connection body of the embodiment before melting in the melting process.

In the core-wire connection body 40, for example, the core-wire exposed part 13 is inserted between inner wall surfaces 42*b*, 42*b* through an opening between free ends 42*a*, 42*a* of the piece parts 42, 42 and placed on an inner wall surface (bottom surface) 41*a* of the bottom part 41 (FIGS. 2 to 4). The core-wire exposed part 13 is physically and electrically connected with the core-wire connection body 40 on the inner wall surface 41*a* side of the bottom part 41 and the inner wall surfaces 42*b*, 42*b* side of the piece parts 42, 42.

The piece parts 42, 42 protrude in the same direction from both ends of the bottom part 41 and are oppositely disposed at an interval S1 between the inner wall surfaces 42*b*, 42*b* (FIGS. 3 and 4). The core-wire connection body 40 in this example is formed so that the bottom part 41 and the pair of piece parts 42, 42 have rectangular flat plate shapes and the same plate thickness.

The cover connection body 50 includes a barrel bottom part 51 and a pair of barrel piece parts 52, 52 protruding from both ends of the barrel bottom part 51 (FIGS. 1 and 2). The cover connection body 50 is formed in a plate shape of a U figure constituted by the barrel bottom part 51 and the pair of barrel piece parts 52, 52 before connection with the cover 11 at the terminal of the electrical wire 10 (before being physically connected with the cover 11 at the terminal of the electrical wire 10). For example, a part with the cover 11 at the terminal of the electrical wire 10 is inserted inside the cover connection body 50 through an opening between free ends 52*a*, 52*a* of the respective barrel piece parts 52, 52 and placed on an inner wall surface (bottom surface) 51*a* of the barrel bottom part 51. The cover 11 at the terminal of the electrical wire 10 is physically connected with the cover connection body 50 on the inner wall surface 51*a* side of the barrel bottom part 51 and inner wall surface 52*b*, 52*b* sides of the barrel piece parts 52, 52.

The barrel piece parts 52, 52 protrude in the same direction from both ends of the barrel bottom part 51 and are oppositely disposed at an interval between the inner wall surfaces 52*b*, 52*b*. The cover connection body 50 in this example is formed so that the barrel bottom part 51 and the pair of barrel piece parts 52, 52 have rectangular flat plate shapes and the same plate thickness.

A connection target of the terminal fitting 20 is the electrical wire 10 in which a core-wire diameter D1 of the core-wire exposed part 13 is smaller than a protrusion height H of each piece part 42, 42 from a lowermost surface 41*a*$_1$ of the bottom part 41 (FIGS. 3 and 4). The lowermost surface 41$a_1$ of the bottom part 41 is a part of the inner wall surface 41*a* of the bottom part 41, which is most separated from the piece part 42, 42 sides in a direction opposite the protrusion direction of the piece parts 42, 42. In the bottom part 41 in this example, the inner wall surface 41*a* itself is the lowermost surface 41$a_1$. The core-wire connection body 40 is formed in a shape in which the protrusion height H of each piece part 42, 42 from the lowermost surface 41$a_1$ of the bottom part 41 is larger than the core-wire diameter D1 of the core-wire exposed part 13. The electrical wire 10 as the connection target of the terminal fitting 20 not only satisfies this requirement related to the protrusion height H but also has the core-wire diameter D1 that is equal to or smaller than the interval S1 between the inner wall surfaces 42*b*, 42*b* of the piece parts 42, 42. Accordingly, the core-wire connection body 40 is formed in a shape in which the interval S1 between the inner wall surfaces 42*b*, 42*b* of the piece parts 42, 42 is equal to or larger than the core-wire diameter D1 of the core-wire exposed part 13.

In the terminal-equipped electrical wire 1, the terminal of the electrical wire 10 is installed in the core-wire connection body 40 and the cover connection body 50, the core-wire exposed part 13 and the core-wire connection body 40 are welded to each other, and then the cover 11 at the terminal of the electrical wire 10 and the cover connection body 50 are bonded to each other by pressing. Thus, the method of manufacturing the terminal-equipped electrical wire 1 includes an electrical wire installation process of installing the terminal of the electrical wire 10 in the core-wire connection body 40 and the cover connection body 50. In addition, the method of manufacturing the terminal-equipped electrical wire 1 includes a melting process and a fixation process of welding the core-wire exposed part 13 and the core-wire connection body 40 to each other and also includes a press bonding process of bonding the cover 11 at the terminal of the electrical wire 10 and the cover connection body 50 to each other by pressing.

In the electrical wire installation process, the core-wire exposed part 13 is inserted between the inner wall surfaces 42*b*, 42*b* of the piece parts 42, 42 of the core-wire connection body 40 and placed on the inner wall surface 41*a* of the bottom part 41 of the core-wire connection body 40 (FIG. 3). The electrical wire installation process may be performed on the terminal fitting 20 placed on an installation table (not illustrated) such as a jig or housed in a housing (not illustrated) such as a housing box made of synthesis resin by a worker holding the electrical wire 10 or by a device holding the electrical wire 10 with an arm or the like.

In the electrical wire installation process in this example, the core-wire exposed part 13 of the core wire 12 including the strands 12*a* is inserted between the inner wall surfaces 42*b*, 42*b* of the piece parts 42, 42 and placed on the inner wall surface 41*a* of the bottom part 41. Accordingly, in the electrical wire installation process in this example, the core-wire exposed part 13 is inserted toward the inner side of the core-wire connection body 40 to avoid unravel of the strands 12*a*.

In addition, in the electrical wire installation process in this example, the core-wire exposed part 13 is inserted between the inner wall surfaces 42*b*, 42*b* of the piece parts 42, 42 and placed on the inner wall surface 41*a* of the bottom part 41 so that the cover 11 of the electrical wire 10 at the terminal is inserted between the inner wall surfaces 52*b*, 52*b* of the barrel piece parts 52, 52 and placed on the inner wall surface 51*a* of the barrel bottom part 51.

In the terminal fitting 20 in this example, the inner wall surface 41*a* of the bottom part 41 of the core-wire connection body 40 and the inner wall surface 51*a* of the barrel bottom part 51 of the cover connection body 50 are positioned on an identical plane. Thus, in the electrical wire installation process in this example, the core-wire exposed part 13 potentially floats above the inner wall surface 41*a* of the bottom part 41 by at least the thickness of the cover 11, depending on the length and weight of the core-wire exposed part 13. In FIGS. 3 and 4, for the purpose of illustration, the core-wire exposed part 13 floats above the inner wall surface 41*a* of the bottom part 41. However, in a case of such floating in the electrical wire installation process, for example, the terminal of the electrical wire 10 is tilted to press the core-wire exposed part 13 against the inner wall surface 41*a* of the bottom part 41 so that the core-wire exposed part 13 is placed on the inner wall surface 41*a* of the bottom part 41. In this example, a bulging part (not illustrated) having a height equivalent to the thickness of the cover 11 may be provided on the inner wall surface 41*a* of the bottom part 41. In the electrical wire installation process in this case, the core-wire exposed part 13 may be placed on the bulging part to avoid floating of the core-wire exposed part 13.

In the manufacturing method, any of the melting and fixation processes and the press bonding process may be performed first. For example, in the press bonding process, the part with the cover 11 at the terminal of the electrical wire 10 extends in the axis line direction when the cover connection body 50 is swaged and bonded by pressing to the cover 11 at the terminal of the electrical wire 10 as described later. Thus, in the manufacturing method, the melting process and the fixation process may be performed after the press bonding process with taken into account the extension of the electrical wire 10. In the terminal-equipped electrical wire 1, the electrical wire 10 is pulled in the axis line direction to the outside from the cover connection body 50. Thus, in the press bonding process, the part with the cover 11 at the terminal can be extended in the direction in which the electrical wire 10 is pulled out. Accordingly, in the manufacturing method, the melting and fixation processes may be performed first and then, the press bonding process may be performed.

In the melting process, a laser irradiation device (not illustrated) is controlled to emit a laser beam LB (FIG. 4). In the melting process, the laser beam LB is emitted to the core-wire exposed part 13 and the core-wire connection body 40 from the free end 42*a*, 42*a* side of each piece part 42, 42, thereby melting the core-wire exposed part 13 and the core-wire connection body 40. The melting of the core-wire exposed part 13 and the core-wire connection body 40 starts at a part irradiated with the laser beam LB.

The laser beam LB is emitted to, for example, the entire piece parts 42, 42 in an axis line direction (direction orthogonal to the protrusion direction and opposite disposition direction of the piece parts 42, 42) of the core-wire exposed part 13. The laser beam LB is emitted at a width in the opposite disposition direction of the piece parts 42, 42, the width being larger than the interval S1 between the inner wall surfaces 42*b*, 42*b* of the piece parts 42, 42 at the free ends 42*a*, 42*a* and smaller than an interval S2 between outer wall surfaces 42*c*, 42*c* of the piece parts 42, 42 at the free ends 42*a*, 42*a* (FIG. 4). Since the laser beam LB is emitted at such a narrow width, it is possible to prevent irradiation of any unnecessary place with the laser beam LB, and when the terminal fitting 20 is housed in the housing as described above, it is possible to prevent irradiation of the housing with the laser beam LB. However, in a case without such disadvantages, the laser beam LB may be emitted to the entire piece parts 42, 42 in the opposite disposition direction of the piece parts 42, 42.

Figure 5:
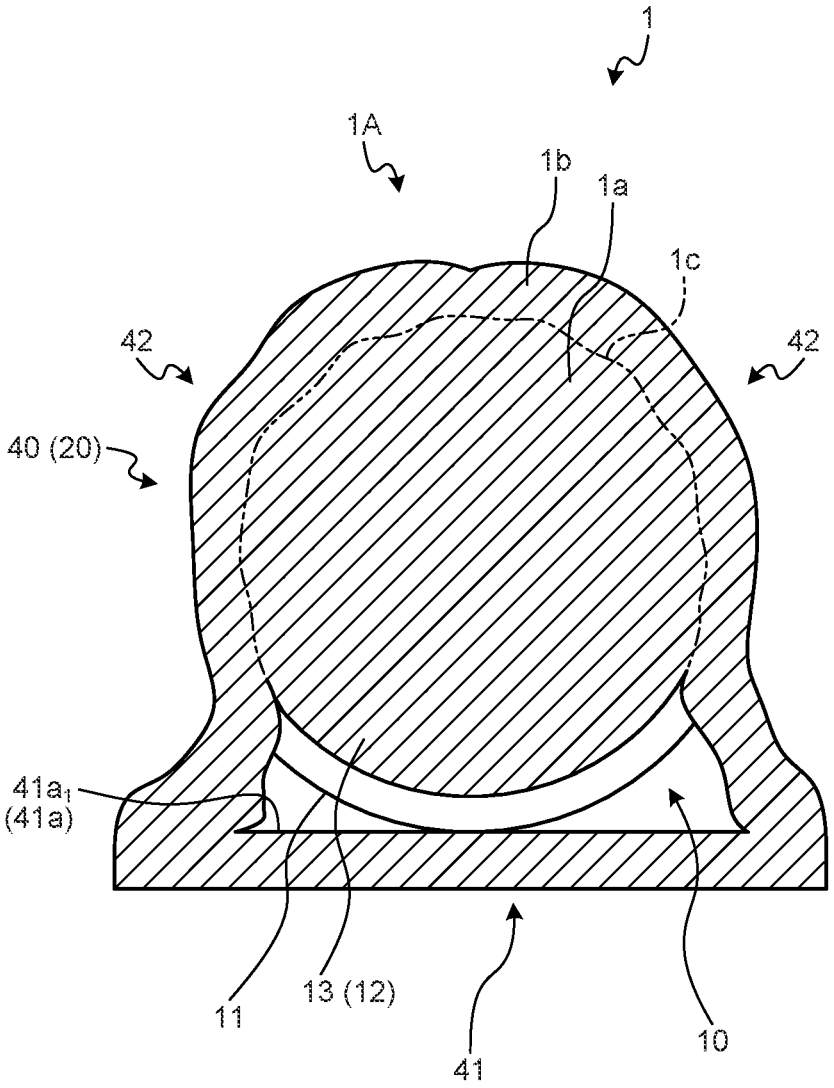
FIG. 5 is a cross-sectional view illustrating the core-wire exposed part and the core-wire connection body of the embodiment subjected to the fixation process.

As described above, the connection target of the terminal fitting 20 is the electrical wire 10 having the core-wire diameter D1 smaller than the protrusion height H of each piece part 42, 42 from the lowermost surface 41$a_1$ of the bottom part 41. Thus, in the core-wire connection body 40, the free ends 42*a*, 42*a* of the piece parts 42, 42 are closer to a laser beam LB emission part side than the core-wire exposed part 13. Thus, in the melting process, the laser beam LB having the above-described irradiation range is first emitted to the free end 42*a*, 42*a* sides of the piece parts 42, 42, and then emitted to the laser beam LB emission part side of the core-wire exposed part 13. In the melting process, as the free end 42*a*, 42*a* sides of the piece parts 42, 42 melt, the melted free end 42*a*, 42*a* sides of the piece parts 42, 42 are all or partially placed on the core-wire exposed part 13 having started melting. In the melting process, the laser beam LB is emitted to melted parts on the free end 42*a*, 42*a* sides of the piece parts 42, 42 placed on the core-wire exposed part 13, thereby melting the core-wire exposed part 13 together with the melted parts of the piece parts 42, 42. In the melting process, the laser beam LB is emitted until the boundary between melted parts of the core-wire exposed part 13 and the core-wire connection body 40 becomes blurred (FIG. 5). For example, in the melting process, the intensity of the laser beam LB may be adjusted to melt the core-wire exposed part 13 up to the bottom part 41 side.

Inside the core-wire connection body 40, there is a gap between the inner wall surface 42*b*, 42*b* of each piece part 42, 42 and the core-wire exposed part 13 when the core-wire diameter D1 is smaller than the interval S1 between the inner wall surfaces 42*b*, 42*b* of the piece parts 42, 42. Thus, in the melting process, the laser beam LB can enter between the inner wall surface 42*b*, 42*b* of the piece part 42, 42 and the core-wire exposed part 13, depending on the size of the gap and the distance between the position of the gap and the free end 42*a*, 42*a* of the piece part 42, 42. In this case, in the melting process, the laser beam LB can be emitted to a part of the inner wall surface 42*b*, 42*b* of the piece part 42, 42, which is disposed opposite the core-wire exposed part 13 and to a part of the core-wire exposed part 13, which is disposed opposite to the piece part 42, 42. Accordingly, the laser beam LB potentially reaches the bottom part 41 through the gap between the inner wall surface 42*b*, 42*b* of the piece part 42, 42 and the core-wire exposed part 13. However, in such a case as well, the laser beam LB, which has high directionality, is incident on an end part of the bottom part 41 on the piece part 42, 42 side. In the melting process, the end part of the bottom part 41 on the piece part 42, 42 side can be melted until the free end 42*a*, 42*a* sides of the melted piece parts 42, 42 all or partially cover the core-wire exposed part 13.

The manufacturing method proceeds to the fixation process after the melting process. In the fixation process, the laser irradiation device is controlled to stop the emission of the laser beam LB from the laser irradiation device. Specifically, in the fixation process, the irradiation with the laser beam LB is stopped to fix the core-wire exposed part 13 and the core-wire connection body 40 being melted by the laser beam LB. Accordingly, in the fixation process, the core-wire exposed part 13 and the core-wire connection body 40 can be physically and electrically connected with each other.

In the fixation process in this example after the boundary between the melted parts of the core-wire exposed part 13 and the core-wire connection body 40 has become blurred in the melting process, the emission of the laser beam LB is stopped and the melted parts are fixed (FIG. 5). Specifically, the core-wire exposed part 13 and the core-wire connection body 40 form a melted-fixed part 1A that is melted and then fixed through the melting process and the fixation process. The melted-fixed part 1A is substantially divided into a first fixation region 1*a* of the melted core-wire exposed part 13 and a second fixation region 1*b* of the melted core-wire connection body 40. In the melted-fixed part 1A in this example, the first fixation region 1*a* and the second fixation region 1*b* are fixed to each other in a boundary region therebetween. The boundary region is impossible or difficult to be visually recognized depending on a melting state in some cases, and thus is denoted by Reference sign 1*c* and illustrated with a dashed and double-dotted line for sake of illustration.

The press bonding process uses a press bonding machine (not illustrated) having a configuration well known in the present technical field. In the press bonding process, the cover connection body 50 in which the cover 11 at the terminal of the electrical wire 10 is housed is sandwiched and pressurized between upper and lower molds of the press bonding machine so that the barrel piece parts 52, 52 are wrapped around the cover 11 at the terminal of the electrical wire 10 in accordance with, for example, the shape of the upper mold.

As described above, in the method of manufacturing the terminal-equipped electrical wire and the terminal-equipped electrical wire 1 of the present embodiment, since the laser beam LB is first emitted to the free end 42*a*, 42*a* sides of the piece parts 42, 42 and then emitted to the laser beam LB emission part side of the core-wire exposed part 13, the free end 42*a*, 42*a* sides of the melted piece parts 42, 42 are all or partially placed on the core-wire exposed part 13 having started melting. Then, in the method of manufacturing the terminal-equipped electrical wire and the terminal-equipped electrical wire 1, the core-wire exposed part 13 is melted by the laser beam LB together with melted parts of the piece parts 42, 42 placed on the core-wire exposed part 13, and the boundary between melted parts thereof becomes blurred and fixed. Thus, in the method of manufacturing the terminal-equipped electrical wire and the terminal-equipped electrical wire 1, the core-wire exposed part 13 and the core-wire connection body 40 can be solidly fixed through the fixation process. Accordingly, in the method of manufacturing the terminal-equipped electrical wire and the terminal-equipped electrical wire 1 of the present embodiment, the core-wire exposed part 13 and the core-wire connection body 40 are connected with each other in a desirable and stable state, thereby making it possible to improve the quality of conduction between the electrical wire 10 and the terminal fitting 20.

In the method of manufacturing the terminal-equipped electrical wire and the terminal-equipped electrical wire 1 of the present embodiment, in the melting process, the laser beam LB is emitted to melted parts of the free end 42*a*, 42*a* sides of the piece parts 42, 42 placed on the core-wire exposed part 13 having started melting, thereby melting the melted parts of the free end 42*a*, 42*a* sides of the piece parts 42, 42 and the core-wire exposed part 13. Accordingly, in the method of manufacturing the terminal-equipped electrical wire and the terminal-equipped electrical wire 1, in the melting process, the melted parts of the free end 42*a*, 42*a* sides of the piece parts 42, 42 cover the core-wire exposed part 13, which can prevent the core-wire exposed part 13 from being continuously directly irradiated with the laser beam LB. For example, at the core-wire exposed part 13, the strands 12*a* are potentially unraveled or melted due to continuous direct irradiation with the laser beam LB. In the method of manufacturing the terminal-equipped electrical wire and the terminal-equipped electrical wire 1 of the present embodiment, since the melted parts of the free end 42*a*, 42*a* sides of the piece parts 42, 42 cover the core-wire exposed part 13 through the melting process, such unraveling and melting of the strands 12*a* can be prevented. In the method of manufacturing the terminal-equipped electrical wire and the terminal-equipped electrical wire 1, for this reason as well, the core-wire exposed part 13 and the core-wire connection body 40 are connected with each other in a desirable and stable state, thereby making it possible to improve the quality of conduction between the electrical wire 10 and the terminal fitting 20.

In addition, in the method of manufacturing the terminal-equipped electrical wire and the terminal-equipped electrical wire 1 of the present embodiment, the terminal of the electrical wire 10 is placed on the bottom part 41 of the core-wire connection body 40 and the bottom part 51 of the cover connection body 50, and the core-wire exposed part 13 and the core-wire connection body 40 are irradiated with the laser beam LB and welded. Thus, in the method of manufacturing the terminal-equipped electrical wire and the terminal-equipped electrical wire 1, no process of fabricating the electrical wire 10 as in conventional cases needs to be performed before the electrical wire installation process, and no process of temporarily fastening the core-wire exposed part 13 and the core-wire connection body 40 needs to be performed after the electrical wire installation process. Accordingly, it is possible to improve productivity in the method of manufacturing the terminal-equipped electrical wire and the terminal-equipped electrical wire 1.

In addition, in the method of manufacturing the terminal-equipped electrical wire and the terminal-equipped electrical wire 1 of the present embodiment, the barrel bottom parts used for swage press bonding to the core-wire exposed part 13, and the barrel piece parts thereof can be used as the bottom part 41 and the piece parts 42, 42 of the core-wire connection body 40. Thus, in the method of manufacturing the terminal-equipped electrical wire and the terminal-equipped electrical wire 1, a terminal fitting for swage press bonding can be used as the terminal fitting 20 of the present invention, and thus, for example, an existing terminal fitting for swage press bonding can be used as the terminal fitting 20 of the present invention. Accordingly, in the method of manufacturing the terminal-equipped electrical wire and the terminal-equipped electrical wire 1, cost reduction can be achieved. In addition, since an existing housing can be used as the above-described housing, cost reduction can be achieved for this reason as well.

First Modification

Figure 6:
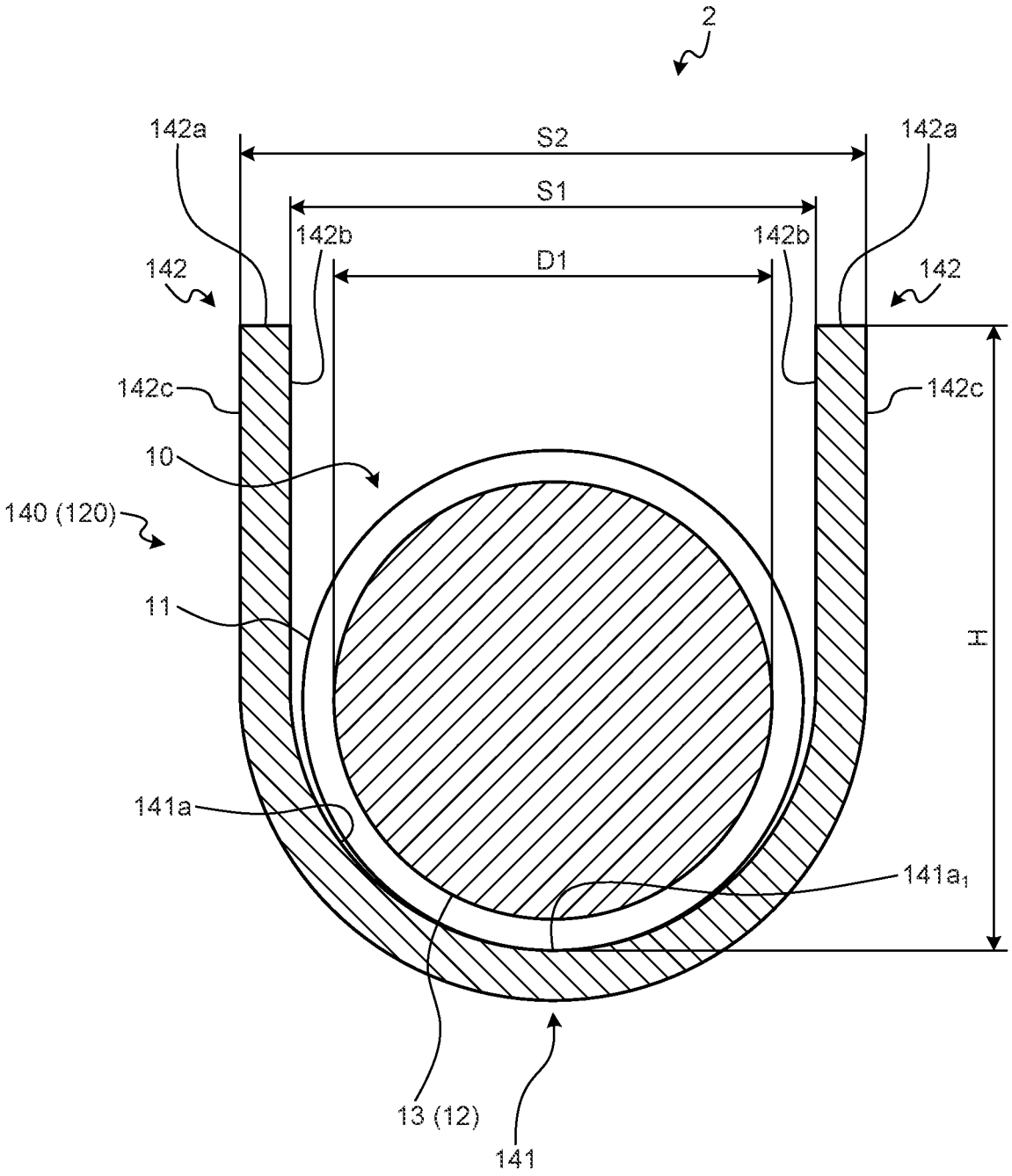
FIG. 6 illustrates a core-wire exposed part and a core-wire connection body of a first modification before being subjected to the melting process and the fixation process.
Figure 7:
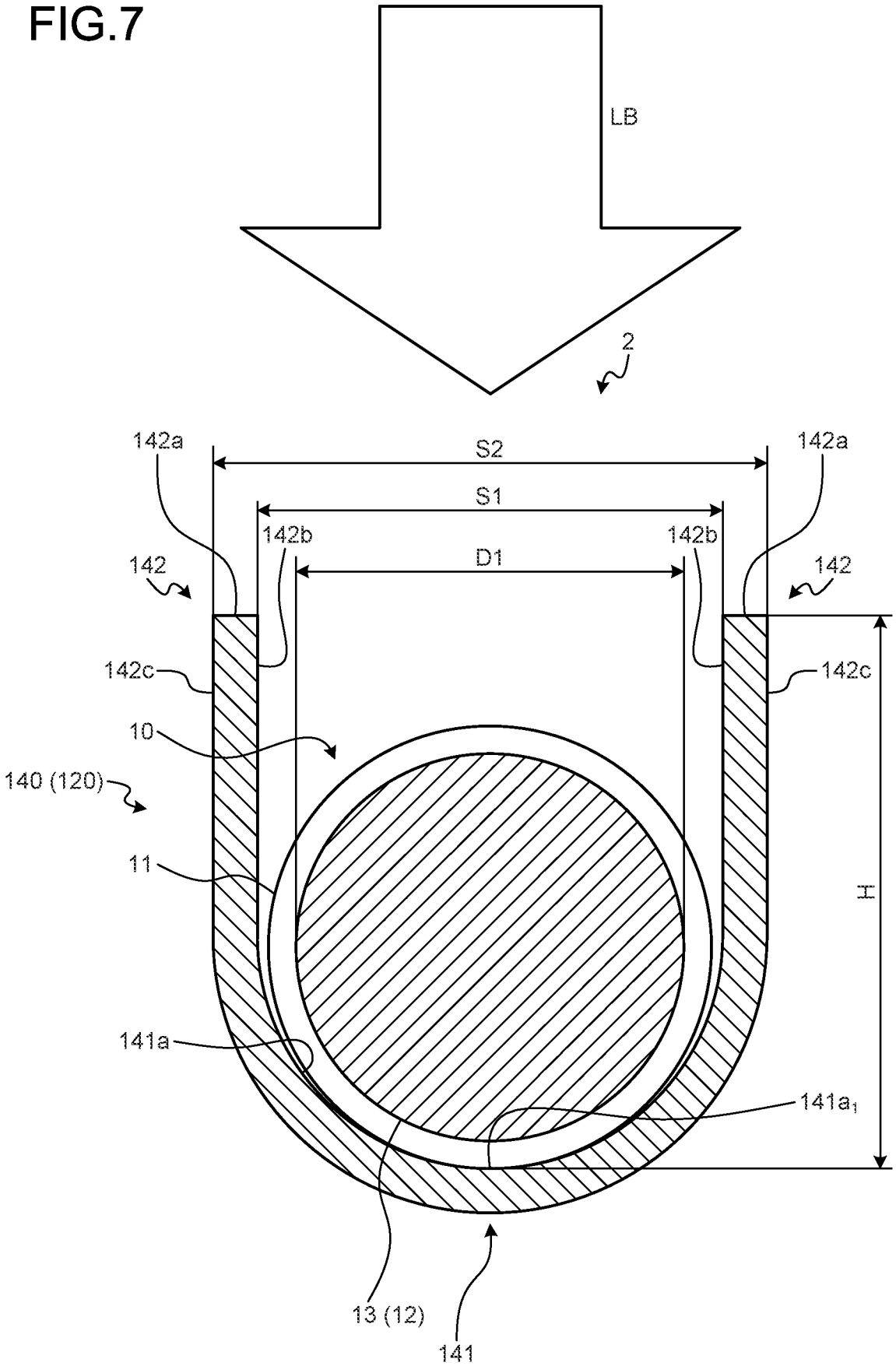
FIG. 7 is a cross-sectional view illustrating the core-wire exposed part and the core-wire connection body of the first modification before melting in the melting process.
Figure 8:
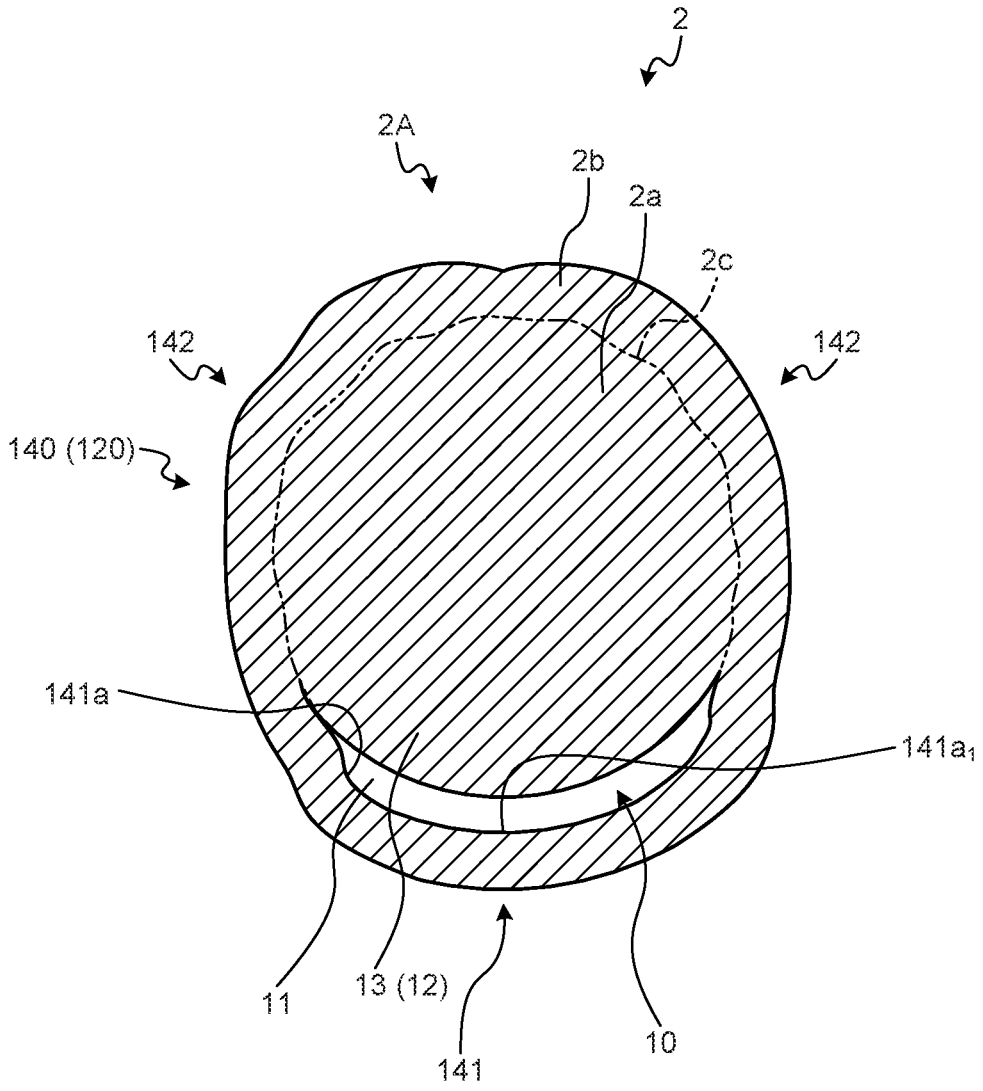
FIG. 8 is a cross-sectional view illustrating the core-wire exposed part and the core-wire connection body of the first modification subjected to the fixation process.

A method of manufacturing a terminal-equipped electrical wire of the present modification manufactures a terminal-equipped electrical wire 2 in which a terminal fitting 120 to be described later is attached to the terminal of the electrical wire 10 (FIGS. 6 to 8).

The terminal fitting 120 of the present modification corresponds to, for example, the terminal fitting 20 of the above-described embodiment in which at least the core-wire connection body 40 is replaced with a core-wire connection body 140 to be described later (FIGS. 6 and 7). The core-wire connection body 140 includes an arc-shaped bottom part 141 and a pair of piece parts 142, 142 protruding from both ends of the bottom part 141. The core-wire connection body 140 before connection with the core-wire exposed part 13 (before physical and electrical connection with the core-wire exposed part 13) is formed in a plate shape of a U figure formed of the bottom part 141 and the pair of piece parts 142, 142. Hereinafter, the shape of the core-wire connection body 140 means its shape before connection with the core-wire exposed part 13 unless otherwise stated.

In the core-wire connection body 140, similarly to the core-wire connection body 40 of the embodiment, the core-wire exposed part 13 is inserted between inner wall surfaces 142*b*, 142*b* through an opening between free ends 142*a*, 142*a* of the piece parts 142, 142 and placed on an arc-shaped inner wall surface (bottom surface) 141*a* of the bottom part 141 (FIG. 6). The core-wire exposed part 13 is physically and electrically connected with the core-wire connection body 140 on the inner wall surface 141*a* side of the bottom part 141 and the inner wall surface 142*b*, 142*b* sides of the piece parts 142, 142.

The core-wire connection body 140 is formed in a shape in which the protrusion height H of each piece part 142, 142 from a lowermost surface $\mathbf{141}a_1$ of the bottom part 141 is larger than the core-wire diameter D1 of the core-wire exposed part 13. The lowermost surface $\mathbf{141}a_1$ of the bottom part 141 is defined as in the embodiment and is a part of the inner wall surface 141*a* of the bottom part 141, which is most separated from the piece parts 142, 142 side in a direction opposite the protrusion direction of the piece parts 142, 142 to be described later. The core-wire connection body 140 is formed in a shape in which the interval S1 between the inner wall surfaces 142*b*, 142*b* of the piece parts 142, 142 is equal to or larger than the core-wire diameter D1 of the core-wire exposed part 13.

The arc-shaped inner wall surface 141*a* of the bottom part 141 may be formed in an arc shape having a diameter equal to the core-wire diameter D1 of the core-wire exposed part 13 or may be formed in a shape in which a section of the core-wire exposed part 13 orthogonal to the axis line is an incircle of the inner wall surface 141*a* when the core-wire exposed part 13 is placed on the arc-shaped inner wall surface 141*a*. When the orthogonal section of the core-wire exposed part 13 is the incircle, the core-wire diameter D1 of the core-wire exposed part 13 is smaller than the interval S1 between the inner wall surfaces 142*b*, 142*b* of the piece parts 142, 142 inside the core-wire connection body 140, which can provide a gap between the inner wall surface 142*b*, 142*b* of each piece part 142, 142 and the core-wire exposed part 13.

The piece parts 142, 142 protrude in the same direction from both ends of the bottom part 141 and are oppositely disposed at the interval S1 between the inner wall surfaces 142*b*, 142*b* thereof (FIGS. 6 and 7). In the core-wire connection body 140 in this example, the bottom part 141 is formed in an arc and plate shape, each piece part 142, 142 is formed in a rectangular flat plate shape, and both parts have the same plate thickness.

In the electrical wire installation process of the present modification, similarly to the electrical wire installation process of the embodiment, the core-wire exposed part 13 having the incircle section is placed on the arc-shaped inner wall surface 141*a* of the bottom part 141 (FIG. 6).

The melting process of the present modification is performed similarly to the melting process of the embodiment. Specifically, in the melting process of the present modification, the laser beam LB is emitted at a width in the opposite disposition direction of the piece parts 142, 142, the width being larger than the interval S1 between the inner wall surfaces 142*b*, 142*b* of the piece parts 142, 142 at the free ends 142*a*, 142*a* and smaller than the interval S2 between outer wall surfaces 142*c*, 142*c* of the piece parts 142, 142 at the free ends 142*a*, 142*a* (FIG. 7).

In the present modification as well, the free ends 142*a*, 142*a* of the piece parts 142, 142 are positioned on the laser beam LB emission part side of the core-wire exposed part 13 inside the core-wire connection body 140. Thus, in the present modification as well, in the melting process, the laser beam LB is first emitted to the free end 142*a*, 142*a* sides of the piece parts 142, 142 and then emitted to the laser beam LB emission part side of the core-wire exposed part 13. Accordingly, as the free end 142*a*, 142*a* sides of the piece parts 142, 142 melt, the melted free end 142*a*, 142*a* sides of the piece parts 142, 142 are all or partially placed on the core-wire exposed part 13 having started melting. In the present modification as well, in the melting process, the laser beam LB is emitted to melted parts of the free end 142*a*, 142*a* sides of the piece parts 142, 142 placed on the core-wire exposed part 13, thereby melting the core-wire exposed part 13 together with the melted parts of the piece parts 142, 142. In the melting process, the laser beam LB is emitted until the boundary between melted parts of the core-wire exposed part 13 and the core-wire connection body 140 becomes blurred (FIG. 8). For example, in the melting process, the intensity of the laser beam LB may be adjusted to melt the core-wire exposed part 13 up to the bottom part 41 side.

In the present modification as well, inside the core-wire connection body 140, there is a gap between the inner wall surface 142*b*, 142*b* of each piece part 142, 142 and the core-wire exposed part 13 when the core-wire diameter D1 is smaller than the interval S1 between the inner wall surfaces 142*b*, 142*b* of the piece parts 142, 142. Thus, in the present modification as well, in the melting process, the laser beam LB can enter between the inner wall surface 142*b*, 142*b* of the piece part 142, 142 and the core-wire exposed part 13, depending on the distance between the size of the gap and the position of the gap and the free end 142*a*, 142*a* of the piece part 142, 142, and potentially reaches the bottom part 141 through a gap therebetween. Thus, in the present modification as well, in the melting process, an end part of the bottom part 141 on the piece part 142, 142 side can be melted until the free end 142*a*, 142*a* sides of the melted piece parts 142, 142 all or partially cover the core-wire exposed part 13.

The piece parts 142, 142 may protrude both ends of the bottom part 141 so that the interval S1 between the inner wall surfaces 142*b*, 142*b* thereof increases as the position moves toward the free end 142*a*, 142*a* sides. In this case as well, the laser beam LB is emitted at a width in the opposite disposition direction of the piece parts 142, 142, the width being larger than the interval S1 between the inner wall surfaces 142*b*, 142*b* of the piece parts 142, 142 at the free ends 142*a*, 142*a* and smaller than the interval S2 between the outer wall surfaces 142*c*, 142*c* of the piece parts 142, 142 at the free ends 142*a*, 142*a*. However, the interval S1 of the piece parts 142, 142 in this case needs to be set at each position so that melted parts of the free end 142*a*, 142*a* sides can cover the core-wire exposed part 13 through emission of the laser beam LB.

In the present modification as well, in the fixation process after the boundary between the melted parts of the core-wire exposed part 13 and the core-wire connection body 140 has become blurred in the melting process, the emission of the laser beam LB is stopped and the melted parts are fixed (FIG. 8). Specifically, the core-wire exposed part 13 and the core-wire connection body 140 form a melted-fixed part 2A that is melted and then fixed through the melting process and the fixation process. The melted-fixed part 2A is substantially divided into a first fixation region 2*a* of the melted core-wire exposed part 13 and a second fixation region 2*b* of the melted core-wire connection body 140. In the melted-fixed part 2A in this example, the first fixation region 2*a* and the second fixation region 2*b* are fixed to each other in a boundary region therebetween. The boundary region is impossible or difficult to be visually recognized depending on a melting state in some cases, and thus is denoted by Reference sign 2*c* and illustrated with a dashed and double-dotted line for sake of illustration.

In the present modification as well, the method of manufacturing the terminal-equipped electrical wire and the terminal-equipped electrical wire 2 can achieve effects same as those of the method of manufacturing the terminal-equipped electrical wire and the terminal-equipped electrical wire 1 of the embodiment.

Second Modification

Figure 9:
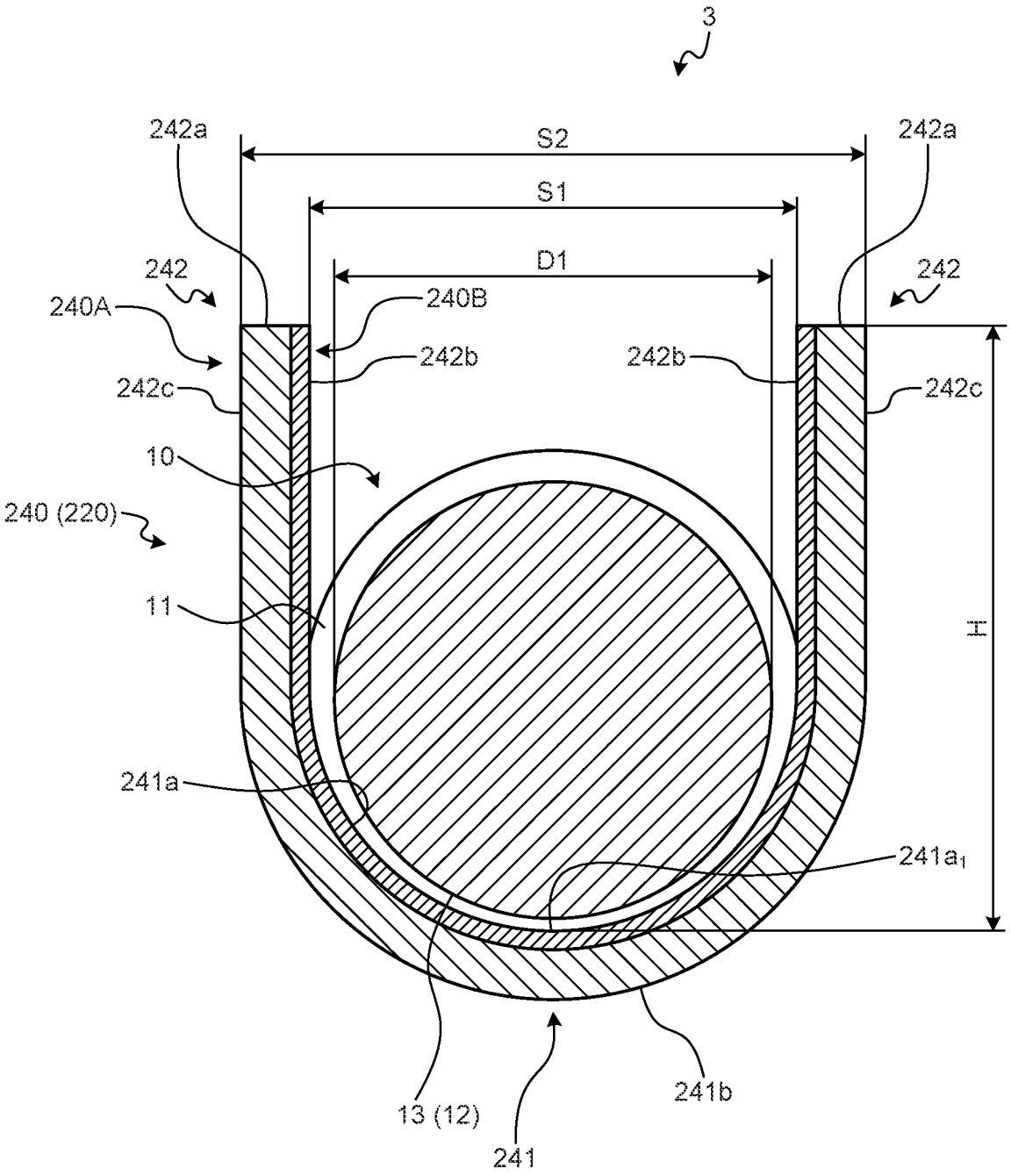
FIG. 9 illustrates a core-wire exposed part and a core-wire connection body of a second modification before being subjected to the melting process and the fixation process.
Figure 10:
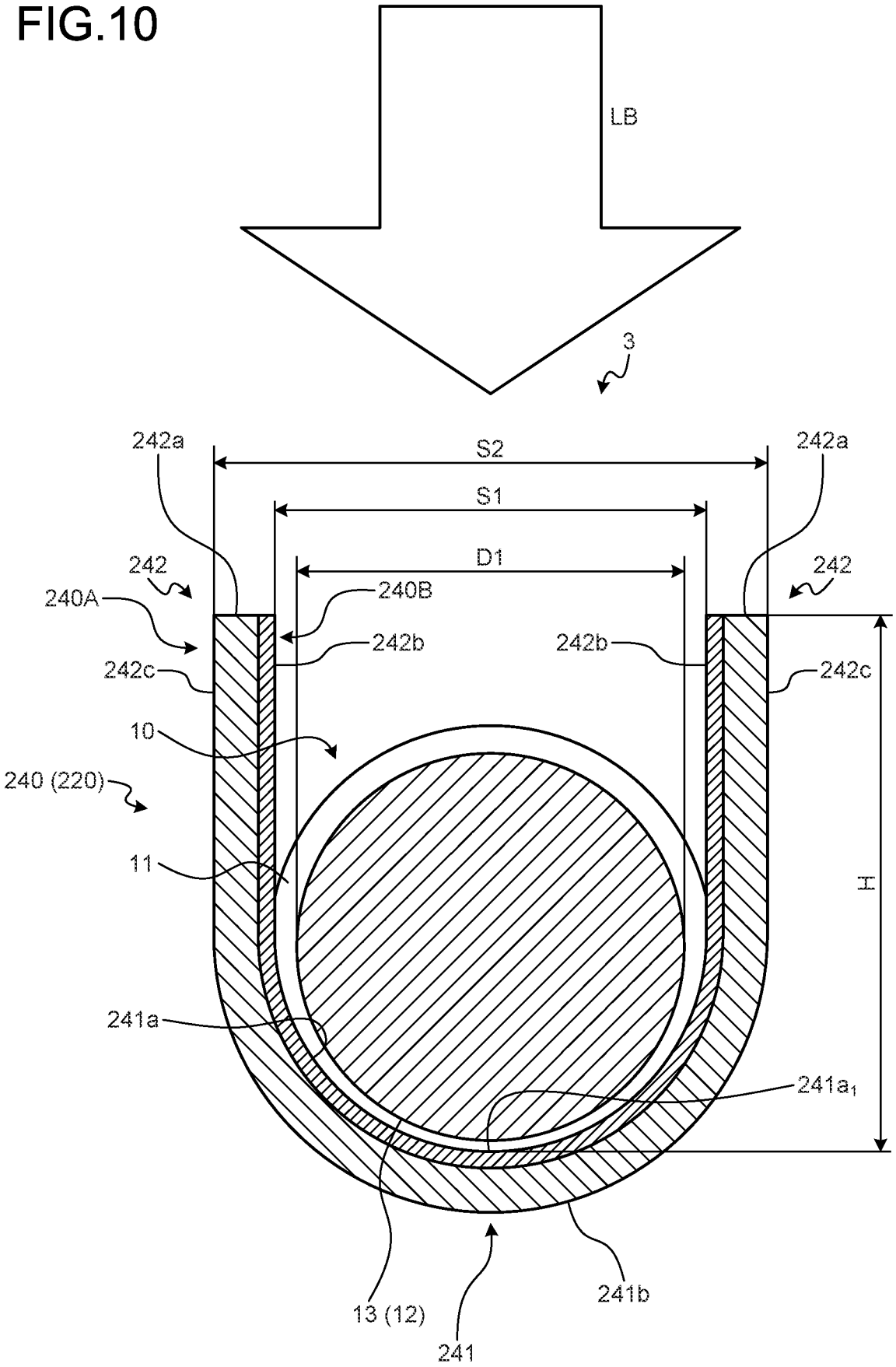
FIG. 10 is a cross-sectional view illustrating the core-wire exposed part and the core-wire connection body of the second modification before melting in the melting process.
Figure 11:
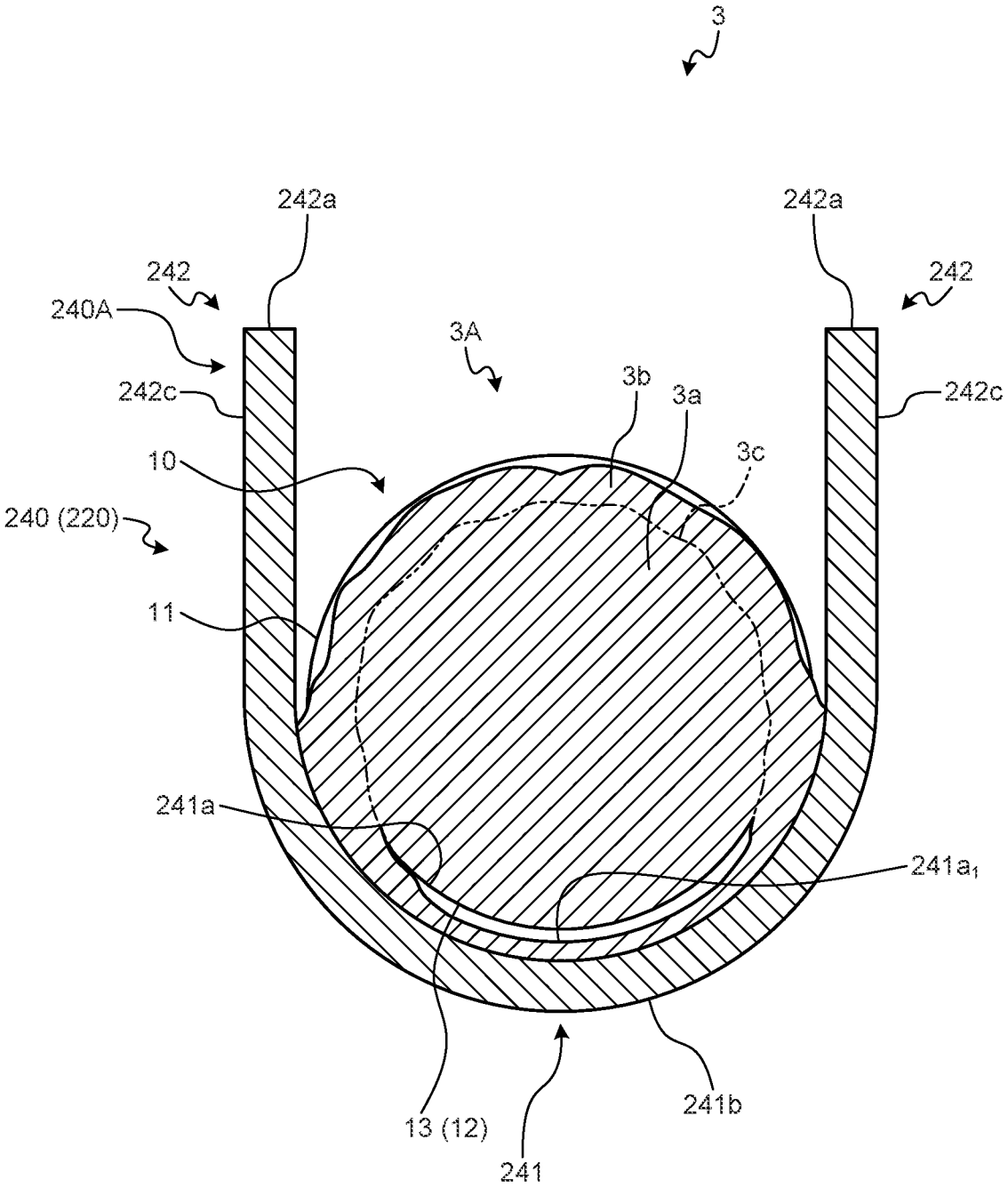
FIG. 11 is a cross-sectional view illustrating the core-wire exposed part and the core-wire connection body of the second modification subjected to the fixation process.
Figure 12:
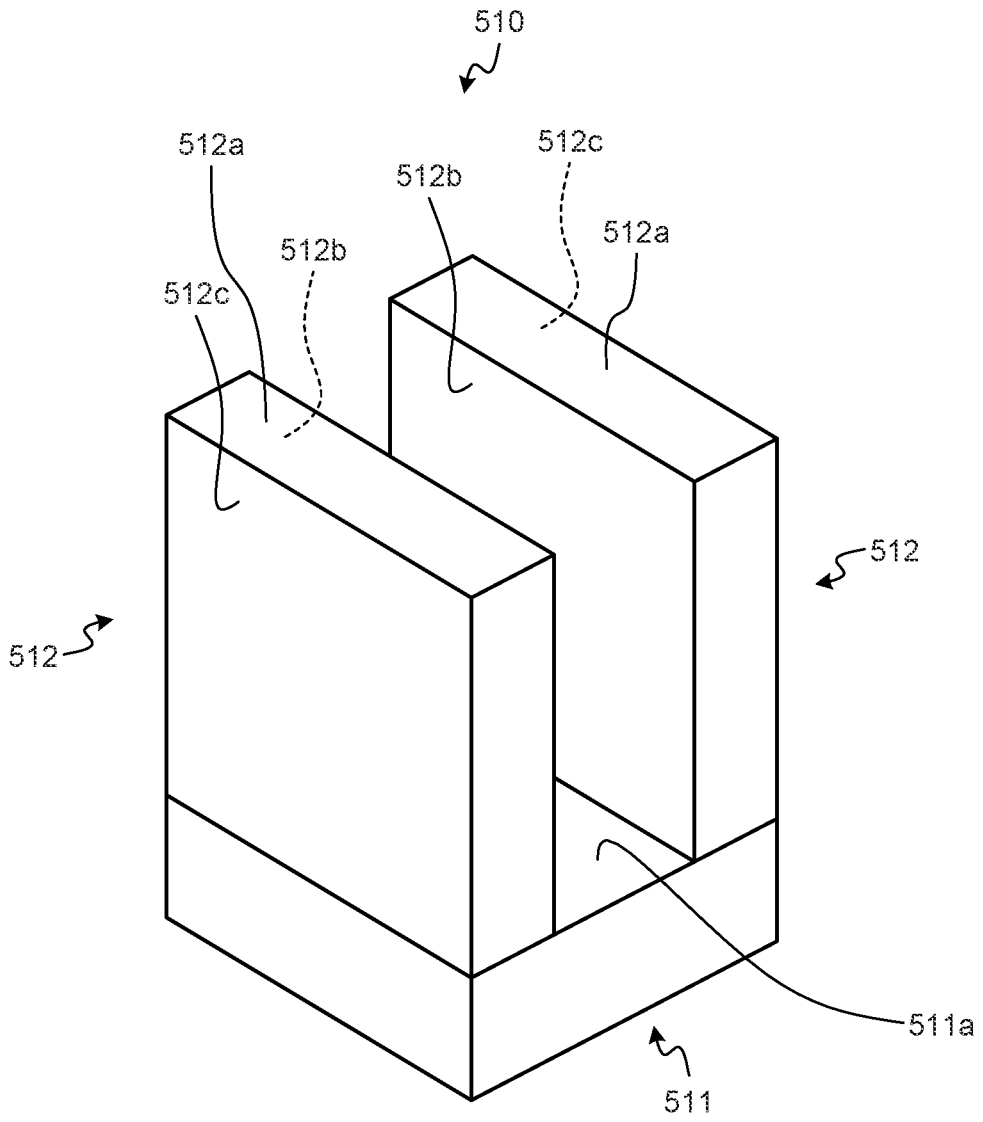
FIG. 12 is a perspective view illustrating a terminal holding jig of a third modification.

A method of manufacturing a terminal-equipped electrical wire of the present modification manufactures a terminal-equipped electrical wire 3 in which a terminal fitting 220 to be described later is attached to the terminal of the electrical wire 10 (FIGS. 9 to 11).

The terminal fitting 220 of the present modification corresponds to, for example, the terminal fitting 20 of the above-described embodiment in which at least the core-wire connection body 40 is replaced with a core-wire connection body 240 to be described later (FIGS. 9 and 10). The core-wire connection body 240 includes an arc-shaped bottom part 241 and a pair of piece parts 242, 242 protruding from both ends of the bottom part 241. The core-wire connection body 240 before connection with the core-wire exposed part 13 (before physical and electrical connection with the core-wire exposed part 13) is formed in a plate shape of a U figure formed of the bottom part 241 and the pair of piece parts 242, 242. Hereinafter, the shape of the core-wire connection body 240 means its shape before connection with the core-wire exposed part 13 unless otherwise stated.

In the core-wire connection body 240, similarly to the core-wire connection body 40 of the embodiment, the core-wire exposed part 13 is inserted between inner wall surfaces 242*b*, 242*b* through an opening between free ends 242*a*, 242*a* of the piece parts 242, 242 and placed on an arc-shaped inner wall surface (bottom surface) 241*a* of the bottom part 241. The core-wire exposed part 13 is physically and electrically connected with the core-wire connection body 240 on the inner wall surface 241*a* side of the bottom part 241 and the inner wall surface 242*b*, 242*b* sides of each piece part 242, 242.

However, the core-wire connection body 240 of the present modification includes an outer wall layer 240A on an outer wall surface (outer wall surface 241*b* of the bottom part 241 and outer wall surfaces 242*c*, 242*c* of the pair of piece parts 142) side, and an inner wall layer 240B on an inner wall surface (inner wall surface 241*a* of the bottom part 241 and inner wall surfaces 242*b*, 242*b* of the pair of piece parts 142) side, which is made of a metallic material having a melting point lower than that of the outer wall layer 240A (FIGS. 9 and 10). Thus, in the core-wire connection body 240 of the present modification, the core-wire exposed part 13 is inserted between the inner wall surfaces 242*b*, 242*b* of the inner wall layer 240B through the opening between the free ends 242*a*, 242*a* of the piece parts 242, 242 and placed on the arc-shaped inner wall surface 241*a* of the inner wall layer 240B of the bottom part 241. In the core-wire connection body 240, the inner wall layer 240B and the core-wire exposed part 13 are welded. The outer wall layer 240A is provided at a main body (including the terminal connection body) of the terminal fitting 220.

For example, the terminal fitting 220 of the present modification is formed of a metal plate as a parent material including a clad part made of two kinds of metallic materials. The clad part is provided at at least a part of the metal plate as a parent material, which is to be formed as the core-wire connection body 240. In the core-wire connection body 240, for example, the outer wall layer 240A is made of copper or copper alloy, and the inner wall layer 240B is made of aluminum or aluminum alloy.

In the core-wire connection body 240 of the present modification, the inner wall layer 240B may be formed by plating. In this case, the inner wall layer 240B is formed as a plating layer having a film thickness for a volume necessary for welding with the core-wire exposed part 13. For example, the inner wall layer 240B is formed as a tin plating layer having a film thickness of 0.1 mm or larger.

In the core-wire connection body 240 of the present modification, the inner wall layer 240B may be formed of solder. For example, the inner wall layer 240B is formed of paste solder applied on an inner wall surface of the outer wall layer 240A.

The core-wire connection body 240 is formed in a shape in which the protrusion height H of each piece part 242, 242 from a lowermost surface 241$a_1$ of the inner wall layer 240B of the bottom part 241 is higher than the core-wire diameter D1 of the core-wire exposed part 13. The lowermost surface 241$a_1$ of the bottom part 241 is defined as in the embodiment and is a part of the inner wall surface 241*a* of the bottom part 241, which is most separated from the piece parts 242, 242 side in a direction opposite the protrusion direction of the piece parts 242, 242 to be described later. In addition, the core-wire connection body 240 is formed in a shape in which the interval S1 between the inner wall surfaces 242*b*, 242*b* of the inner wall layer 240B of the piece parts 242, 242 is equal to or larger than the core-wire diameter D1 of the core-wire exposed part 13.

In the bottom part 241, the arc-shaped inner wall surface 241*a* of the inner wall layer 240B may be formed in an arc shape having a diameter equal to the core-wire diameter D1 of the core-wire exposed part 13 or may be formed in a shape in which a section orthogonal to the axis line of the core-wire exposed part 13 is an incircle of the inner wall surface 241*a* when the core-wire exposed part 13 is placed on the arc-shaped inner wall surface 241*a* of the inner wall layer 240B. When the orthogonal section of the core-wire exposed part 13 is the incircle, the core-wire diameter D1 of the core-wire exposed part 13 is smaller than the interval S1 between the inner wall surfaces 242*b*, 242*b* of the inner wall layer 240B of the piece parts 242, 242 inside the core-wire connection body 240, which can provide a gap between the inner wall surface 242*b*, 242*b* of the inner wall layer 240B of each piece part 242, 242 and the core-wire exposed part 13.

The piece parts 242, 242 protrude in the same direction from both ends of the bottom part 241 and are oppositely disposed at the interval S1 between the inner wall surfaces 242*b*, 242*b* thereof (FIGS. 9 and 10). In the core-wire connection body 240 in this example, the bottom part 241 is formed in an arc and plate shape, each piece part 242, 242 is formed in a rectangular flat plate shape, and both parts have the same plate thickness. The piece parts 242, 242 may protrude from both ends of the bottom part 241 so that the interval S1 between the inner wall surfaces 242*b*, 242*b* thereof increases as the position moves toward the free end 242*a*, 242*a* sides.

In the electrical wire installation process of the present modification, similarly to the electrical wire installation process of the embodiment, the core-wire exposed part 13 having the incircle section is placed on the arc-shaped inner wall surface 241*a* of the inner wall layer 240B of the bottom part 241 (FIG. 9).

In the melting process of the present modification, at least the inner wall layer 240B is melted at the core-wire connection body 240. However, the melting process of the present modification does not exclude melting of the outer wall layer 240A. In the melting process in this example, only the inner wall layer 240B is melted at the core-wire connection body 240. Thus, the laser beam LB is adjusted to an intensity for melting the inner wall layer 240B only. For example, similarly to the melting process of the embodiment, the laser beam LB is emitted at a width in the opposite disposition direction of the piece parts 242, 242, the width being larger than the interval S1 between the inner wall surfaces 242*b*, 242*b* of the inner wall layer 240B of the piece parts 242, 242 at the free ends 242*a*, 242*a* and smaller than the interval S2 between the outer wall surfaces 242*c*, 242*c* of the outer wall layer 240A of the piece parts 242, 242 at the free ends 242*a*, 242*a* (FIG. 10). Accordingly, in the melting process, only the inner wall layer 240B is melted at the core-wire connection body 240. The laser beam LB may have an irradiation range between the free end of one of the piece parts 242 on the inner wall layer 240B and the free end of the other piece part 242 on the inner wall layer 240B. In other words, the laser beam LB may be emitted only to the inner wall layer 240B and the core-wire exposed part 13. In this case as well, in the melting process, only the inner wall layer 240B is melted at the core-wire connection body 240.

In the present modification as well, the free end 242*a*, 242*a* (the free end 242*a*, 242*a* on the inner wall layer 240B) of each piece part 242, 242 is positioned on the laser beam LB emission part side of the core-wire exposed part 13 inside the core-wire connection body 240. Thus, in the present modification as well, in the melting process, the laser beam LB is first emitted to the free end 242*a*, 242*a* sides of the piece parts 242, 242 and then emitted to the laser beam LB emission part side of the core-wire exposed part 13, the piece parts 242, 242. Accordingly, as the free end 242*a*, 242*a* sides melt, the melted free end 242*a*, 242*a* sides of the piece parts 242, 242 are all or partially placed on the core-wire exposed part 13 having started melting. Specifically, in the melting process of the present modification, as the free end 242*a*, 242*a* sides of the inner wall layer 240B of the piece parts 242, 242 melt, the melted free end 242*a*, 242*a* sides of the inner wall layer 240B are all or partially placed on the core-wire exposed part 13 having started melting. In the melting process of the present modification, the laser beam LB is emitted to melted parts of the free end 242*a*, 242*a* sides of the inner wall layer 240B placed on the core-wire exposed part 13, thereby melting the core-wire exposed part 13 together with the melted parts of the inner wall layer 240B. In the melting process of the present modification, the laser beam LB is emitted until the boundary between melted parts of the core-wire exposed part 13 and the inner wall layer 240B of the core-wire connection body 240 becomes blurred (FIG. 11). For example, in the melting process, the intensity of the laser beam LB may be adjusted to melt the core-wire exposed part 13 up to the bottom part 141 side.

In the present modification as well, inside the core-wire connection body 240, there is a gap between each inner wall surface 242*b*, 242*b* of the inner wall layer 240B and the core-wire exposed part 13 when the core-wire diameter D1 is smaller than the interval S1 between the inner wall surfaces 242*b*, 242*b* of the inner wall layer 240B of the piece parts 242, 242. Thus, in the present modification as well, in the melting process, the laser beam LB can enter between each inner wall surface 242*b*, 242*b* of the inner wall layer 240B and the core-wire exposed part 13, depending on the size of the gap and the distance between the position of the gap and the free end 242*a*, 242*a* of the inner wall layer 240B of each piece part 242, 242, and potentially reaches the bottom part 241 through a gap therebetween. Thus, in the present modification as well, in the melting process, an end part of the bottom part 241 on each piece part 242, 242 side can be melted until the melted free end 242*a*, 242*a* sides of the inner wall layer 240B all or partially cover the core-wire exposed part 13.

In the fixation process of the present modification, when the boundary between the melted parts of the core-wire exposed part 13 and the inner wall layer 240B of the core-wire connection body 240 has become blurred in the melting process, the emission of the laser beam LB is stopped, and the melted parts are fixed (FIG. 11). Specifically, the core-wire exposed part 13 and the inner wall layer 240B of the core-wire connection body 240 form a melted-fixed part 3A that is melted and then fixed through the melting process and the fixation process. The melted-fixed part 3A is substantially divided into a fixation region 3*a* of the melted core-wire exposed part 13 and a fixation region 3*b* of the inner wall layer 240B of the melted core-wire connection body 240. In the melted-fixed part 3A in this example, the first fixation region 3*a* and the second fixation region 3*b* are fixed to each other in a boundary region therebetween. The boundary region is impossible or difficult to be visually recognized depending on a melting state in some cases, and thus is denoted by Reference sign 3*c* and illustrated with a dashed and double-dotted line for sake of illustration.

In the present modification as well, the method of manufacturing the terminal-equipped electrical wire and the terminal-equipped electrical wire 3 can achieve effects same as those of the method of manufacturing the terminal-equipped electrical wire and the terminal-equipped electrical wire 1 of the embodiment. In addition, in the method of manufacturing the terminal-equipped electrical wire and the terminal-equipped electrical wire 3 of the present modification, the intensity of the laser beam LB can be set low as compared to those of the above-described embodiment and the first modification, and thus thermal influence of the laser beam LB on surroundings (for example, thermal influence on the above-described housing) can be reduced in the melting process. Moreover, in the method of manufacturing the terminal-equipped electrical wire and the terminal-equipped electrical wire 3 of the present modification can achieve reduced cost as compared to those of the above-described embodiment and the first modification because of the laser beam LB at a low intensity.

Third Modification

In the method of manufacturing the terminal-equipped electrical wire of each of the embodiment and the first and the second modifications described above, the core-wire connection body 40, 140, or 240 is installed on the terminal holding jig before the electrical wire installation process. In other words, in the method of manufacturing the terminal-equipped electrical wire, a terminal installation process of installing the core-wire connection body 40, 140, or 240 on the terminal holding jig is provided before the electrical wire installation process. Thus, the present modification describes the terminal installation process together with an exemplary terminal holding jig and provides an exemplary melting process when the terminal holding jig is used. The following description will be made on an example with the terminal fitting 120 of the first modification.

A terminal holding jig 500 used in the terminal installation process includes a placement part 511 on which the bottom part 141 of the core-wire connection body 140 is placed, and a pair of side wall parts 512, 512 protruding from both ends of the placement part 511 and sandwiching the piece parts 142, 142 of the core-wire connection body 140 (FIGS. 12 to 16). To entirely cover the piece parts 142, 142, the pair of side wall parts 512, 512 include free ends 512*a*, 512*a* protruding beyond the free ends 142*a*, 142*a* of the piece parts 142, 142.

The terminal holding jig 500 may be prepared to install, for example, the core-wire connection body 140 only. In this case, although not illustrated, a terminal holding jig (not illustrated) for installing the terminal connection body of the terminal fitting 120 only, and a terminal holding jig (not illustrated) for installing the cover connection body of the terminal fitting 120 only may be prepared in addition to the terminal holding jig 500 for the core-wire connection body 140. The terminal holding jig 500 may include, in addition to the placement part 511 and the pair of side wall parts 512, 512 for the core-wire connection body 140, for example, a placement part on which the bottom part of the terminal connection body of the terminal fitting 120 is placed, a placement part on which the bottom part of the cover connection body of the terminal fitting 120 is placed, and a pair of side wall parts protruding from both ends of the placement part for the cover connection body and sandwiching the barrel piece parts of the cover connection body.

In the terminal holding jig 500, at least the pair of side wall parts 512, 512 is made of a laser-beam transmitting material having a melting point higher than the melting points of the core-wire exposed part 13 and the core-wire connection body 140. The laser-beam transmitting material has such a melting-point characteristic and a laser-beam transmittance larger than the sum of laser-beam absorptance and reflectance.

In this example, since the strands 12*a* of the core-wire exposed part 13 are made of aluminum or aluminum alloy and the core-wire connection body 140 is made of copper or copper alloy, the side wall parts 512 made of the laser-beam transmitting material having a melting point higher than the melting points of these materials are used. Specifically, when an infrared laser is used, the laser-beam transmitting material has such as a melting-point characteristic and substantially transmits light in the infrared region (for example, at a transmittance of 90% or higher). When an ultraviolet laser is used, the laser-beam transmitting material has the above-described melting-point characteristic and substantially transmits light in the ultraviolet region (for example, at a transmittance of 90% or higher). More specifically, in this example, the laser-beam transmitting material that satisfies all these requirements may contain quartz glass or fluoride glass as non-quartz glass. When an infrared laser is used, the laser-beam transmitting material may contain chalcogenide glass.

In the terminal holding jig 500 in this example, the placement part 511 and the pair of side wall parts 512, 512 are both made of the laser-beam transmitting material.

Figure 13:
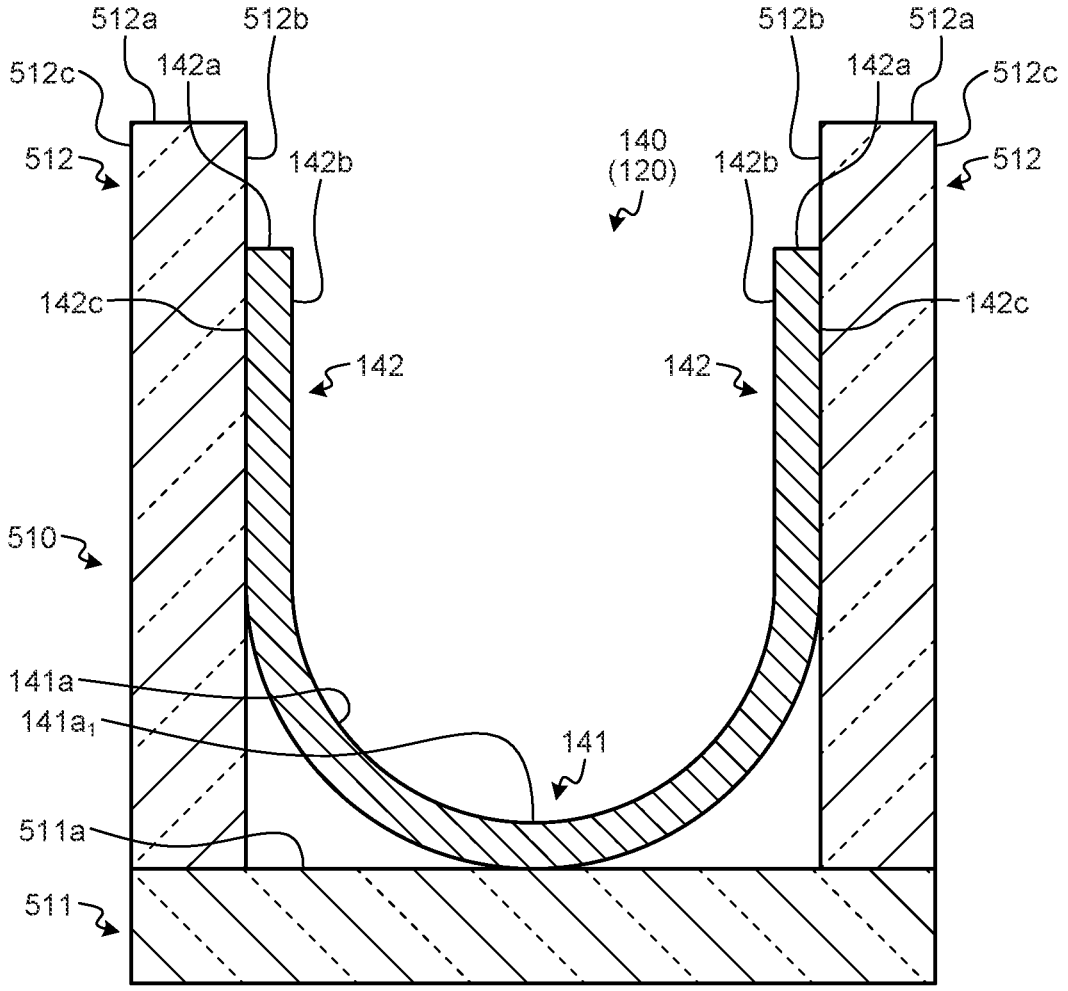
FIG. 13 is a cross-sectional view illustrating a terminal fitting and the terminal holding jig of the third modification subjected to a terminal installation process.

In the terminal installation process using the terminal holding jig 500, the bottom part 141 of the core-wire connection body 140 is placed on an inner wall surface 511*a* of the placement part 511, and the piece parts 142, 142 of the core-wire connection body 140 are sandwiched between the pair of side wall parts 512, 512 (FIG. 13). In this example, inner wall surfaces 512*b*, 512*b* of the pair of side wall parts 512, 512 sandwich the piece parts 142, 142 from the outer wall surface 142*c*, 142*c* sides.

Thereafter, in the manufacturing method of the present modification, the process transitions to the electrical wire installation process of the above-described first modification and then proceeds to the melting process.

Figure 14:
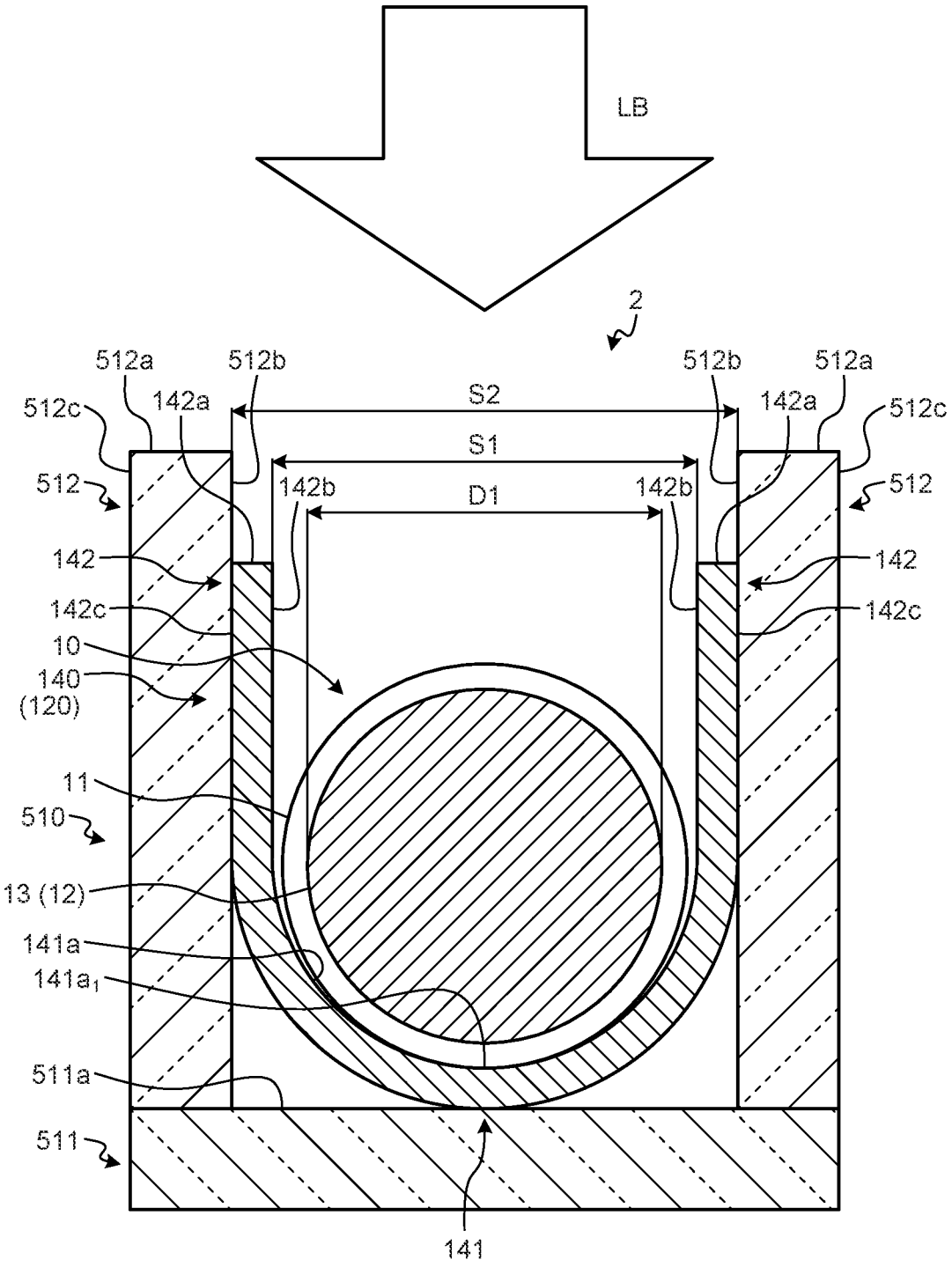
FIG. 14 is a cross-sectional view illustrating, together with the terminal holding jig, a core-wire exposed part and a core-wire connection body of the third modification before melting in the melting process and is a diagram illustrating an exemplary laser beam width.

In the melting process of the present modification, for example, the laser beam LB is emitted similarly to the melting process of the above-described first modification. Specifically, in the melting process of the present modification, the laser beam LB is emitted at a width in the opposite disposition direction of the piece parts 142, 142, the width being larger than the interval S1 between the inner wall surfaces 142*b*, 142*b* of the piece parts 142, 142 at the free ends 142*a*, 142*a* and smaller than the interval S2 between the outer wall surfaces 142*c*, 142*c* of the piece parts 142, 142 at the free ends 142*a*, 142*a* (FIG. 14). In the manufacturing method of the present modification, the terminal-equipped electrical wire 2 same as that of the above-described first modification can be manufactured through this melting process.

Figure 15:
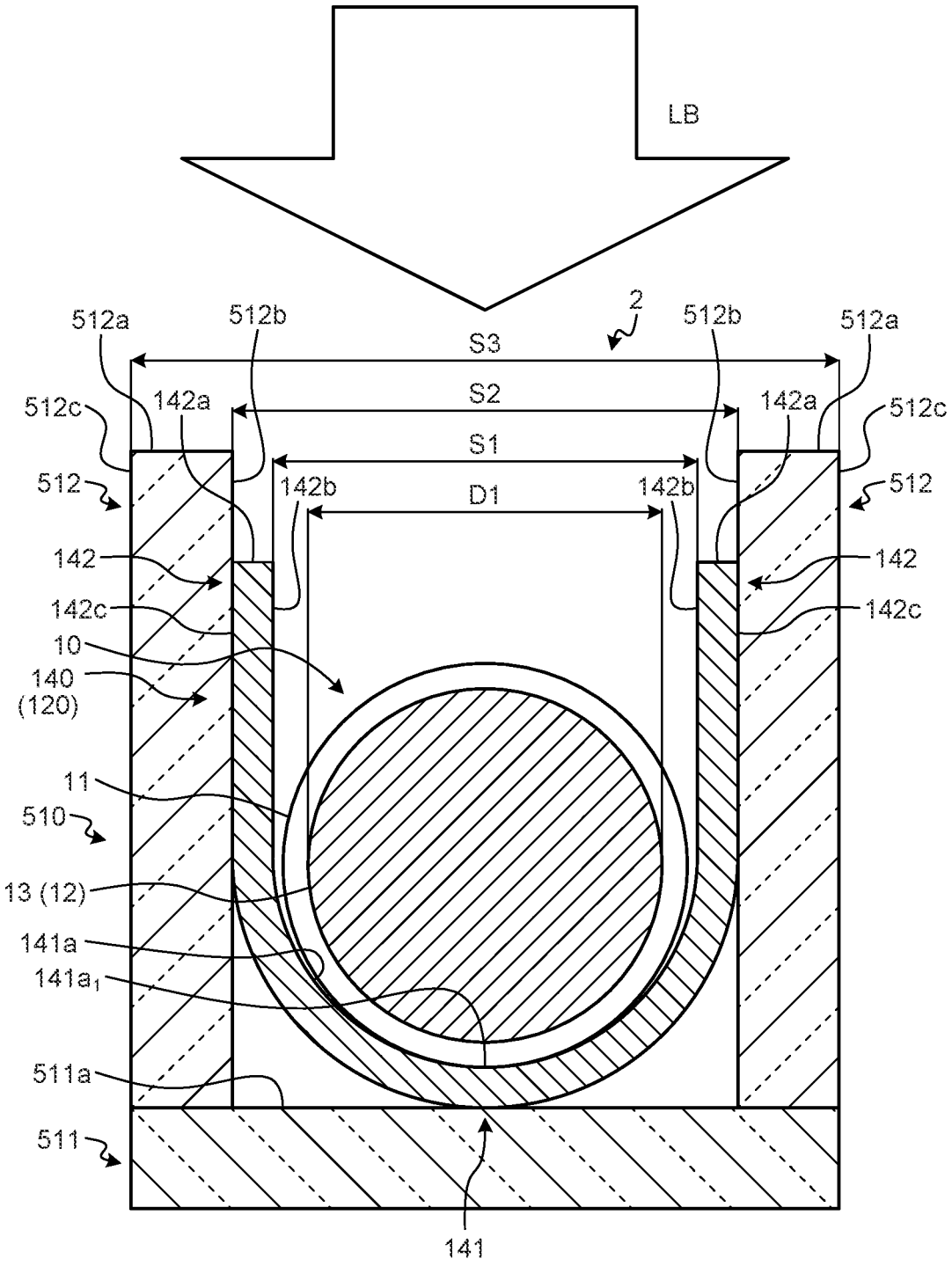
FIG. 15 is a cross-sectional view illustrating, together with the terminal holding jig, the core-wire exposed part and the core-wire connection body of the third modification before melting in the melting process and is a diagram illustrating an exemplary laser beam width.

In the melting process of the present modification, since the above-described terminal holding jig 500 having a high melting point is used, it is possible to avoid melting of the terminal holding jig 500 when the terminal holding jig 500 is irradiated with the laser beam LB having an intensity equivalent to that of the laser beam LB in the embodiment and the first and the second modifications described above. Thus, in the melting process in this example, the laser beam LB is emitted at a width in the opposite disposition direction of the piece parts 142, 142, the width being larger than the interval S1 between the inner wall surfaces 142*b*, 142*b* of the piece parts 142, 142 at the free ends 142*a*, 142*a* and smaller than an interval S3 between outer wall surfaces 512*c*, 512*c* of the side wall parts 512, 512 at the free ends 512*a*, 512*a* (FIG. 15). Accordingly, in the melting process, the laser beam LB is emitted to the entire free ends 142*a*, 142*a* of the piece parts 142, 142. Accordingly, in the melting process, it is easy to simultaneously melt the piece parts 142, 142 and the core-wire exposed part 13, which can lead to an increased effect of preventing unraveling and melting of the strands 12*a* of the core-wire exposed part 13. Thus, with the method of manufacturing the terminal-equipped electrical wire and the terminal-equipped electrical wire 2 of the present modification, it is possible to not only obtain the effects described in the first modification but also further improve the quality of conduction between the electrical wire 10 and the terminal fitting 120 because the core-wire exposed part 13 and the core-wire connection body 140 are connected with each other in a more desirable and more stable state than in the first modification.

Figure 16:
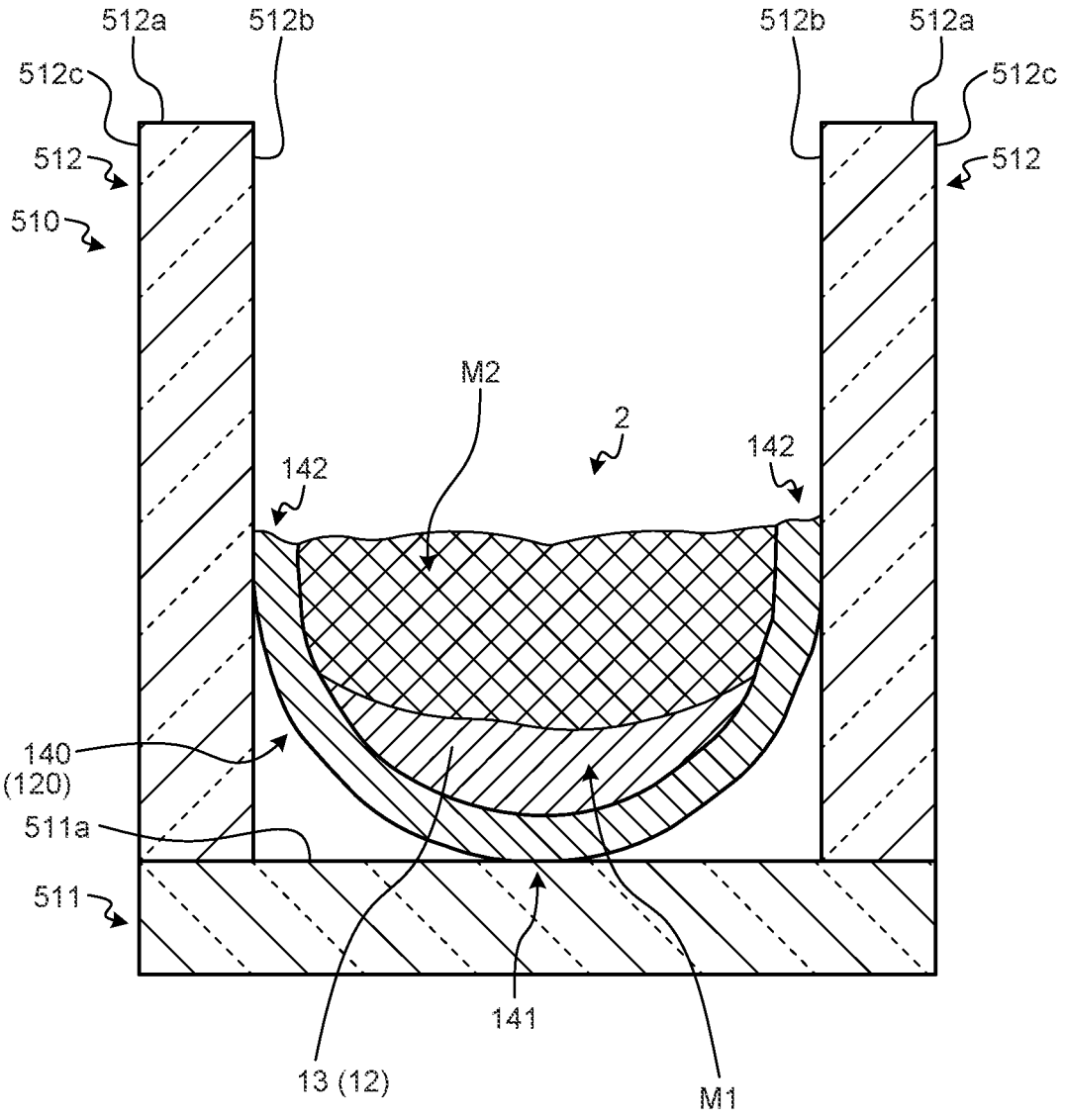
FIG. 16 is a cross-sectional view illustrating, together with the terminal holding jig, the core-wire exposed part and the core-wire connection body of the third modification subjected to the melting process.

FIG. 16 illustrates exemplary melting states of the core-wire exposed part 13 and the core-wire connection body 140 before the fixation process. In FIG. 16, Reference sign M1 denotes a core-wire-only region in which only the core-wire exposed part 13 is melted on the bottom part 141 side. Reference sign M2 denotes a mixture region in which the melted core-wire exposed part 13 and the melted piece parts 142, 142 of the core-wire connection body 140 are mixed.

When the terminal holding jig 500 and the melting process of the present modification (FIG. 15) are applied to the manufacturing method of the above-described embodiment, it is possible, with the method of manufacturing the terminal-equipped electrical wire and the terminal-equipped electrical wire 1, not only to obtain the effects described in the embodiment but also to further improve the quality of conduction between the electrical wire 10 and the terminal fitting 20 because the core-wire exposed part 13 and the core-wire connection body 40 are connection with each other in a more desirable and more stable state than in the embodiment. When the terminal holding jig 500 and the melting process (FIG. 15) of the present modification are applied to the manufacturing method of the above-described second modification, it is possible to further improve the quality of conduction between the electrical wire 10 and the terminal fitting 220 because the core-wire exposed part 13 and the core-wire connection body 240 are connected with each other in a more desirable and more stable state than in the second modification.

In a method of manufacturing a terminal-equipped electrical wire and a terminal-equipped electrical wire according to the present embodiment, a laser beam is first emitted to free end sides of piece parts and then emitted to a laser beam emission part side of a core-wire exposed part, and thus the melted free end sides of the piece parts all or partially are placed on the core-wire exposed part having started melting. Then, in the method of manufacturing the terminal-equipped electrical wire and the terminal-equipped electrical wire, the core-wire exposed part and melted parts of the piece parts placed on the core-wire exposed part are melted by the laser beam and fixed as the boundary between melted parts thereof becomes blurred. Thus, in the method of manufacturing the terminal-equipped electrical wire and the terminal-equipped electrical wire, the core-wire exposed part and the core-wire connection body can be solidly fixed through the fixation process. Accordingly, in the method of manufacturing the terminal-equipped electrical wire and the terminal-equipped electrical wire according to the present embodiment, the core-wire exposed part and the core-wire connection body are connected with each other in a desirable and stable state, thereby making it possible to improve the quality of conduction between an electrical wire and a terminal fitting. Moreover, in the method of manufacturing the terminal-equipped electrical wire and the terminal-equipped the electrical wire according to the present embodiment, the core-wire exposed part is placed on a bottom part of the core-wire connection body, and the core-wire exposed part and the core-wire connection body are welded through laser beam irradiation. Specifically, in the method of manufacturing the terminal-equipped electrical wire and the terminal-equipped the electrical wire, no fabrication process needs to be performed on the electrical wire before an electrical wire installation process as in conventional cases, and no temporary fastening of the core-wire exposed part and the core-wire connection body needs to be performed after the electrical wire installation process. Thus, it is possible to improve productivity of the method of manufacturing the terminal-equipped electrical wire and the terminal-equipped the electrical wire.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A method of manufacturing a terminal-equipped electrical wire, comprising:

an electrical wire installation process including, inserting a core-wire exposed part of a core wire of an electrical wire at a terminal between inner wall surfaces of a pair of piece parts of a terminal fitting including a core-wire connection body formed of a bottom part and the piece parts protruding from both ends of the bottom part and terminating at a respective free end, placing the core-wire exposed part on an inner wall surface of the bottom part, the electrical wire having a core-wire diameter smaller than a protrusion height of each piece part from a lowermost surface of the bottom part, and spacing the core-wire exposed part away from the piece parts;

a melting process including, emitting a laser beam onto the core-wire exposed part and at least a portion of the free ends of each piece part after the core-wire exposed part is spaced away from the piece parts, and melting the core-wire exposed part and the free ends of each piece part by emitting a laser beam to the core-wire exposed part and the free ends of each piece part; and a fixation process including, stopping the emission of the laser beam after melting the core-wire exposed part and each piece part, and allowing the core-wire exposed part and each piece part melted by the laser beam to resolidify and fix together the core-wire exposed part and the core-wire connection body after stopping the emission of the laser beam.

2. The method of manufacturing a terminal-equipped electrical wire according to claim 1, wherein at the melting process, the emitted laser beam has a width larger than an interval between the inner wall surfaces of the piece parts at the free ends and smaller than an interval between outer wall surfaces of the piece parts at the free ends.

3. The method of manufacturing a terminal-equipped electrical wire according to claim 1, further comprising:

a terminal installation process of installing the core-wire connection body on a terminal holding jig including a placement part and a pair of side wall parts protruding from both ends of the placement part, before performing the electrical wire installation process, wherein at the terminal installation process, the bottom part is placed on an inner wall surface of the placement part, and the piece parts are sandwiched between the pair of side wall parts made of a laser-beam transmitting material having a melting point higher than melting points of the core-wire exposed part and each piece part.

4. The method of manufacturing a terminal-equipped electrical wire according to claim 2, further comprising:

a terminal installation process of installing the core-wire connection body on a terminal holding jig including a placement part and a pair of side wall parts protruding from both ends of the placement part, before performing the electrical wire installation process, wherein at the terminal installation process, the bottom part is placed on an inner wall surface of the placement part, and the piece parts are sandwiched between the pair of side wall parts made of a laser-beam transmitting material having a melting point higher than melting points of the core-wire exposed part and each piece part.

5. The method of manufacturing a terminal-equipped electrical wire according to claim 1, further comprising:

a terminal installation process of installing the core-wire connection body on a terminal holding jig including a placement part and a pair of side wall parts protruding from both ends of the placement part, before performing the electrical wire installation process, wherein at the terminal installation process, the bottom part is placed on an inner wall surface of the placement part, and the piece parts are sandwiched between the pair of side wall parts made of a laser-beam transmitting material having a melting point higher than melting points of the core-wire exposed part and each piece part, and at the melting process, the laser beam is emitted at a width larger than an interval between the inner wall surfaces of the piece parts at the free ends and smaller than an interval between outer wall surfaces of the side wall parts at free ends of the side wall parts.

6. The method of manufacturing a terminal-equipped electrical wire according to claim 1, wherein at the electrical wire installation process, the core-wire exposed part in which a section orthogonal to an axis line is an incircle of the arc-shaped inner wall surface of the bottom part is placed on the arc-shaped bottom part.

7. The method of manufacturing a terminal-equipped electrical wire according to claim 2, wherein at the electrical wire installation process, the core-wire exposed part in which a section orthogonal to an axis line is an incircle of the arc-shaped inner wall surface of the bottom part is placed on the arc-shaped bottom part.

8. The method of manufacturing a terminal-equipped electrical wire according to claim 3, wherein at the electrical wire installation process, the core-wire exposed part in which a section orthogonal to an axis line is an incircle of the arc-shaped inner wall surface of the bottom part is placed on the arc-shaped bottom part.

9. The method of manufacturing a terminal-equipped electrical wire according to claim 5, wherein at the electrical wire installation process, the core-wire exposed part in which a section orthogonal to an axis line is an incircle of the arc-shaped inner wall surface of the bottom part is placed on the arc-shaped bottom part.

10. The method of manufacturing a terminal-equipped electrical wire according to claim 1, wherein at the electrical wire installation process, the core-wire exposed part is inserted between inner wall surfaces of the inner wall layer of the piece parts of the core-wire connection body including an outer wall layer on an outer wall surface side and an inner wall layer on an inner wall surface side, which is made of a metallic material having a melting point lower than melting point of the outer wall layer, and the core-wire exposed part is placed on an inner wall surface of the inner wall layer of the bottom part.

11. The method of manufacturing a terminal-equipped electrical wire according to claim 2, wherein at the electrical wire installation process, the core-wire exposed part is inserted between inner wall surfaces of the inner wall layer of the piece parts of the core-wire connection body including an outer wall layer on an outer wall surface side and an inner wall layer on an inner wall surface side, which is made of a metallic material having a melting point lower than melting point of the outer wall layer, and the core-wire exposed part is placed on an inner wall surface of the inner wall layer of the bottom part.

12. The method of manufacturing a terminal-equipped electrical wire according to claim 3, wherein at the electrical wire installation process, the core-wire exposed part is inserted between inner wall surfaces of the inner wall layer of the piece parts of the core-wire connection body including an outer wall layer on an outer wall surface side and an inner wall layer on an inner wall surface side, which is made of a metallic material having a melting point lower than melting point of the outer wall layer, and the core-wire exposed part is placed on an inner wall surface of the inner wall layer of the bottom part.

13. The method of manufacturing a terminal-equipped electrical wire according to claim 5, wherein at the electrical wire installation process, the core-wire exposed part is inserted between inner wall surfaces of the inner wall layer of the piece parts of the core-wire connection body including an outer wall layer on an outer wall surface side and an inner wall layer on an inner wall surface side, which is made of a metallic material having a melting point lower than melting point of the outer wall layer, and the core-wire exposed part is placed on an inner wall surface of the inner wall layer of the bottom part.

14. The method of manufacturing a terminal-equipped electrical wire according to claim 6, wherein at the electrical wire installation process, the core-wire exposed part is inserted between inner wall surfaces of the inner wall layer of the piece parts of the core-wire connection body including an outer wall layer on an outer wall surface side and an inner wall layer on an inner wall surface side, which is made of a metallic material having a melting point lower than melting point of the outer wall layer, and the core-wire exposed part is placed on an inner wall surface of the inner wall layer of the bottom part.

15. The method of manufacturing a terminal-equipped electrical wire according to claim 1, wherein at the electrical wire installation process, the core-wire exposed part of the core wire including a plurality of strands is inserted between the inner wall surfaces of the piece parts and placed on the inner wall surface of the bottom part.

16. The method of manufacturing a terminal-equipped electrical wire according to claim 2, wherein at the electrical wire installation process, the core-wire exposed part of the core wire including a plurality of strands is inserted between the inner wall surfaces of the piece parts and placed on the inner wall surface of the bottom part.

17. The method of manufacturing a terminal-equipped electrical wire according to claim 3, wherein at the electrical wire installation process, the core-wire exposed part of the core wire including a plurality of strands is inserted between the inner wall surfaces of the piece parts and placed on the inner wall surface of the bottom part.

18. The method of manufacturing a terminal-equipped electrical wire according to claim 5, wherein at the electrical wire installation process, the core-wire exposed part of the core wire including a plurality of strands is inserted between the inner wall surfaces of the piece parts and placed on the inner wall surface of the bottom part.

* * * * *